US010975516B2

(12) United States Patent
Bailey

(10) Patent No.: US 10,975,516 B2
(45) Date of Patent: Apr. 13, 2021

(54) CONDENSATE AND LINT SEPARATOR WITHIN A GASEOUS FLUID EXHAUST SYSTEM OF A CLOTHES DRYER

(71) Applicant: Wayne Edward Bailey, Fredericksburg, VA (US)

(72) Inventor: Wayne Edward Bailey, Fredericksburg, VA (US)

( * ) Notice: Subject to any disclaimer, the term of this patent is extended or adjusted under 35 U.S.C. 154(b) by 197 days.

(21) Appl. No.: 15/530,561

(22) Filed: Jan. 30, 2017

(65) Prior Publication Data

US 2019/0003109 A1 Jan. 3, 2019

(51) Int. Cl.
*D06F 58/22* (2006.01)
*D06F 58/24* (2006.01)
*D06F 58/20* (2006.01)

(52) U.S. Cl.
CPC ..... *D06F 58/22* (2013.01); *D06F 58/20* (2013.01); *D06F 58/24* (2013.01)

(58) Field of Classification Search
CPC ..... D06F 58/22; D06F 58/24; D06F 58/20; F26B 25/005; F26B 25/007; B01D 46/003; B01D 46/031; B01D 46/0047; B01D 2279/35
USPC ..... 34/73, 82
See application file for complete search history.

(56) References Cited

U.S. PATENT DOCUMENTS 3,032,887 A * 5/1962 Whyte ..... D06F 58/02 34/524
3,487,624 A * 1/1970 Tignanelli ..... B01D 46/10 34/82
3,999,304 A * 12/1976 Doty ..... A45D 20/52 165/901
4,326,344 A * 4/1982 Smith ..... F28D 15/02 34/566
4,338,731 A * 7/1982 Shames ..... D06F 58/20 137/875
4,434,564 A * 3/1984 Braggins, Jr. ..... D06F 58/20 34/235
4,969,276 A * 11/1990 Walsh ..... D06F 58/20 34/235
6,189,228 B1 * 2/2001 Schuette ..... D06F 58/20 34/235

(Continued)

*Primary Examiner* — Jessica Yuen
(74) *Attorney, Agent, or Firm* — Dale Jensen, PLC; Dale Jensen

(57) ABSTRACT

A housing as part of a clothes dryer's gaseous fluid exhaust system containing components for maintaining an open restriction-free airflow channel for maintaining the dryer's efficiency and sized to fit within a typical wall cavity of a building. A removable airflow filter for filtering and removing excess clothes lint, preventing entry of lint particulate into the upper exhaust vent pipe that may block exhaust airflow or blend with down falling condensate, which is generated from a clothes dryer's warm moist exhaust airflow. A diverter constructed to direct the exhaust airflow to a primary exterior location or to a secondary interior location. A condensate drain to separate falling condensate from exhaust airflow and dispose the condensate into an exclusive disposal system. The elements of this invention combine to secure the efficiency, longer life and safety of a clothes dryer and its exhaust system by removing lint particulate, separating exhaust airflow from falling condensate produced by a clothes dryer into the clothes dryer exhaust system.

10 Claims, 13 Drawing Sheets

(56) References Cited

U.S. PATENT DOCUMENTS

| | | | | |
|---|---|---|---|---|
| 2002/0023368 | A1* | 2/2002 | Beaumont | D06F 58/22 34/79 |
| 2011/0167662 | A1* | 7/2011 | Dittmer | D06F 58/22 34/82 |

* cited by examiner

CONDENSATE AND LINT SEPARATOR WITHIN A GASEOUS FLUID EXHAUST SYSTEM OF A CLOTHES DRYER

FIELD OF INVENTION

The present invention relates to clothes dryer exhaust systems, and more particularly to filtering lint particulate from the clothes dryer's exhaust airflow and separating from falling condensate to prevent blending into a sludge.

The airflow filter intercepts the lint particulate from the exhaust airflow before the exhaust airflow comes in contact with the falling condensate. By removing the lint particulate from the exhaust airflow before the airflow reaches the falling condensate, the risk of lint and condensate blending into a sludge is eliminated.

After the lint has been filtered from the exhaust airflow, the clean exhaust airflow is directed past and separated from the falling condensate.

The exhaust airflow is removed from the gaseous fluid exhaust system through one of the outlet ports.

After separation, the airflow is directed out of the airflow exhaust system through a chosen outlet port and the condensate is directed out through a separate and dedicated condensate port to be disposed of.

In addition the falling condensate water is prevented from entering the clothes dryer and causing damage or from entering the clothes dryer flexible vent pipe and causing blockage.

BACKGROUND

In 2010 an estimated 16,800 reported U.S. non-confirmed or confirmed home structure fires involving clothes dryers or washing machines (including combination washer/dryer) resulted in 51 civilian deaths, 380 civilian injuries, and $236 million in direct property damage.

A clothes dryer works by forcing hot moist air through a turning drum. Wet clothes placed in the drum are then dried by moving hot air. It is possible for a full load of wet clothes to contain as much as one and a half gallons of water. Lint, consisting mostly of small fibers from the clothes and debris in or on the clothes, is created as the clothes tumble in the drum.

While much of the lint is trapped by the dryer's filter, it is also carried through the vent system along with the moist air. Lint is a highly combustible material that can accumulate in the dryer vent. Accumulated lint leads to reduced airflow and can pose a potential fire hazard.

When the warm, moist dryer air reaches an unheated space such as a garage, attic or the outside atmosphere, colder temperatures cause the relative humid air to condense back to liquid form of water within the exhaust pipe. This water can drain back into the clothes dryer or settle in a low point of a dryer vent hose causing blockage and overheating of the dryer, which can result in fire.

Clothes dryer vent pipes are mostly installed with little consideration to problems of condensate water flowing down from the dryer vent exhaust pipe into the clothes dryer or filling up the flexible dryer vent hose at its low point with water. The low point can unintentionally create a water trap which blocks the airflow from the dryer causing the dryer to overheat, loose efficiency or cause a fire.

Another issue with typical clothes dryers is that their filters generally catch less than 80% of the lint produced, this means that over many drying cycles huge amounts of lint can accumulate in the dryer exhaust pipe system. Blending the excess lint from the dryer with the condensate water falling from the exhaust pipe can produce a water/lint blend or a slurry, which can expand inside the exhaust pipe. Over time this slurry can solidify into a firm mass creating even more blockage problems.

Additionally, since most of the dryer vent piping is hidden inside a wall, and many dryer vent systems suffer from poor installation standards and/or the use of improper duct material plus the lack of maintenance it is estimated that there are thousands of house fires annually associated with clothes dryers.

Another issue with current clothes dryer exhaust systems is the in ability to separate the excess lint from the condensate water before they blend together within the exhaust system or being unable to efficiently dispose the lint and water separately.

Still another problem with existing dryer vent systems is the inability for a homeowner to monitor the internal conditions and temperatures of the dryer exhaust system, many problems such as dryer damage or house fires could be reduced if a homeowner could monitor the airflow performance in a simple and convenient way.

According to U.S. Customer product Safety Commission research, a 75% blocked dryer exhaust duct elevates the exhaust air temperature of the average electric clothes dryer 89% more than its normal temperature with an unblocked duct.

Why now?

Laundry rooms are located further from outside walls resulting in longer concealed runs. Given the tightness of modern homes, proper handling of clothes dryer exhaust has become even more critical than it was in older homes that had more breathability. This invention solves these problems and more.

This apparatus includes an enlarged double lint filter to supplement the clothes dryer lint screen. The double filter is easily accessible for removing and replacing. Once removed it can be easily cleaned for the next dryer cycle. Its enlarged double screen feature provides an unrestricted airflow passage through the filter, allowing better dryer efficiency.

This apparatus removes downward flowing condensate water from the exhaust system before it can blend with lint or flow into the clothes dryer. The condensate water is filtered with an easily accessible and removable filter to prevent containments when disposed of into a waste drain. The condensate water drainage system includes water traps to prevent entry of toxic sewer gasses.

The unique combination of embodiments prevents the blending of upward flowing lint with downward flowing condensate water and removes each individually to separate destinations outside the exhaust system.

The easy removable double airflow filter provides more filtering surface resulting in a lint free airflow and a lint free outlet vent pipe for a cleaner environment. Only after the lint has been removed, is the airflow directed to a chosen exit destination. Additionally, the lint does not come in contact with condensate water.

The lower open compartment of the housing provides unique storage for the dryer flexible vent, keeping it up off the floor and well organized for maximum efficiency and for multiple connections and configurations.

The unique condensate water removal system prevents the condensate water from blending with the lint free airflow.

The compact design allows the housing to be installed within a typical 2×4 inch stud wall behind a typical clothes dryer and organize the dryer vent hose to be neatly stored in the lower compartment of the housing.

Another feature of the apparatus are the clear removable viewing windows for interior visual inspections while the system is operational without comprising the airtightness of the upper sealed compartment.

Additionally, the viewing windows can be easily removed to reveal access openings for internal maintenance and diagnostic testing. The access opening and viewing windows are positioned on the housing for easy access and use.

The upper compartment of the apparatus is substantially water tight and air tight to provide a sealed system for high efficiency operations.

An additional feature of the apparatus is an airflow monitor/alarm, strategically located for easy reading and maximum operational efficiency. The monitor indicates to the operator if there are issues with the airflow quality and alert the operator if conditions are critical. Located within the housing is an airtight diverter to direct the filtered airflow to a desired location outside or optionally to an inside destination, and simultaneously direct the falling condensate water away to a different exit port for disposal in a sealed system.

The filters, windows, access openings and airflow monitor represent the operational components and are strategically positioned in the operational zone above the dryer top wall for easy access by the operator of the dryer.

DESCRIPTION OF PRIOR ART

Prior art does not address the problem of falling condensate and excess lint from a clothes dryer within a gaseous fluid exhaust system and their separate disposal.

Generally, clothes dryers do not filter 100% of the lint particulate produced during a typical drying cycle. Additionally, a typical load of clothes cycling through a clothes dryer will produce over 1.5 gallon of water, which is directed upward into the dryer exhaust vent pipe in the form of a high moisture content water vapor.

As the water vapor continues through the exhaust pipe under certain conditions the water vapor turns to condensate and flows back down to the clothes dryer. Additionally, the condensate can mix with the lint particulate creating a slurry like blend which can cause blockage in the dryer vent.

A blockage in the dryer vent can cause the dryer to underperform or over heat and possibly cause a fire.

The present invention comprises new and novel solutions combined to address the need to prevent condensate from entering a clothes dryer and preventing lint intrusion into a dryer exhaust system and for preventing the blending of condensate and lint particulates and directing their separate disposal.

REFERENCES CITED

United States Patents

U.S. Pat. No. 3,847,175 Nov. 12, 1974 Anderson 137/360
U.S. Pat. No. 4,410,004 Oct. 18, 1983 Kifer 174/48
U.S. Pat. No. 4,434,564 Mar. 6, 1984 Braggirs 34/86
U.S. Pat. No. 4,969,276 Nov. 13, 1990 Walsh 34/90
U.S. Pat. No. 5,590,477 Jan. 7, 1997 Carfagno 34/235
U.S. Pat. No. 5,628,122 May 13, 1997 Spinardi 34/79
U.S. Pat. No. 6,230,418 B1 Apr. 26, 2000 Gomulinski 285/278
U.S. Pat. No. 6,419,102 B1 Jul. 16, 2002 Harpenau 220/3.3
U.S. Pat. No. 6,754,976 B1 Jul. 14, 2003 Edwards 34/140
U.S. Pat. No. 8,973,282 B2 Mar. 10, 2015 Mackay 58/22
U.S. Pat. No. 9,103,589 B2 Sep. 27, 2013 Sullivan 58/20
U.S. Pat. No. 9,140,461 B2 Sep. 22, 2015 Bailey (self) 454/356
Ser. Nos. 13/999,836 Mar. 27, 2014 Bailey (self) 454/356

Notice of References Cited (A) U.S. Pat. No. 3,487,624 A Tignanelli Gerald

Examiner's Conclusions; Discloses a housing apparatus for receiving lint exhausted from a clothes dryer.

Applicant response; The Tignanelli invention; A lint trap comprising an enclosure having a chamber and a second chamber with filters adapted to receive lint laden air for passage through enclosure chambers and hollow members to trap the major portion of lint in first enclosure and the remainder in the second filter.

This Tignanelli invention relates to trapping lint through a double filter enclosure.

Additionally, the Tignanelli invention does not address separation of falling condensate from dryer produced lint within a clothes dryer vent system and the separate disposal of each.

application Ser. No. 15/530,561 diverts and removes falling condensate to a dedicated condensate drain within an exhaust vent system, thus preventing contact and blending of falling condensate with incoming lint and preventing falling condensate drainage into a clothes dryer.

(B) U.S. Pat. No. 3,999,304 A Doty; Edward E.

Examiner's Conclusions; Discloses a housing apparatus for receiving lint exhausted from a clothes dryer.

Applicant response; The Doty invention; An exhaust system for a clothes dryer having extending therefrom an exhaust outlet for directing flow of heated air therefrom after its use in the dryer, comprising: a portable filter enclosure, said filter enclosure further having an inlet and an outlet; a flexible hose coupling intermediate said exhaust outlet of said dryer and said inlet of said filter enclosure, said outlet of said filter enclosure further including flow directional control means displaceable to direct the stream of air from the dryer in a desired course; said filter enclosure further including a pivotal lid, a multiple stage filter mounted in said enclosure and accessible responsive to lifting of the lid to a pivoted open condition, each of said filter stages comprising a slidable filter element, moveable vertically relative to said enclosure for ready removal, cleaning and reinsertion.

This Doty invention relates to an improved multiple purpose filter enclosure, associated structure and adjunct for use in conjunction with clothes dryers. It provides the filtering of exhaust air from the dryer and still further adapts it for use not only in heating the room in which the dryer is located when desired but also in using it for hand-held instruments, such as hair dryers, to make a still further utilization of the exhaust.

Additionally, the Doty invention does not address separation of falling condensate from dryer produced lint within a clothes dryer vent system and the separate disposal of each.

application Ser. No. 15/530,561 diverts and removes falling condensate to a dedicated condensate drain within an exhaust vent system, thus preventing contact and blending of falling condensate with incoming lint and preventing falling condensate drainage into a clothes dryer.

(C) U.S. Pat. No. 4,338,731 A Shames; Sidney J.

Examiner's Conclusions; Discloses a housing apparatus for receiving lint exhausted from a clothes dryer.

Applicant response; The Shames invention; In an energy saving hot air vent which includes a selectively swingable, air-directing, valve adapted to direct hot air emitted from a clothes dryer either outdoors, when said valve is in a first position, or indoors when said valve is in a second position; said energy saving vent including housing means having an upstream hot air entry means adapted to receive thereinto hot air from a clothes dryer exhaust hose segment, a downstream hot air exit means adapted to direct hot air from said housing to another exhaust hose segment when said valve is in said first position, and indoor venting port defined in said housing means and adapted to receive hot air from said hot air entry means for discharge therethrough when said valve is in said second position; The Shames invention is an energy saving vent to provide for selectively directing hot, moist exhaust air from a clothes dryer either through a downstream vent sleeve to the outdoors, or through a vent port to the indoors. The vent includes four major components being: an open sided housing; a closure panel for closing one open side of the housing; a valve member within the housing for selectively directing air through the housing in alternate paths; and a filter screen assembly for another open side of the housing.

Additionally, the Shames invention does not address separating falling condensate from incoming lint within a clothes dryer vent system and the separate disposal of each.

application Ser. No. 15/530,561 diverts and removes falling condensate to a dedicated condensate drain within an exhaust vent system, thus preventing contact and blending of falling condensate with incoming lint and preventing falling condensate drainage into a clothes dryer (D) U.S. Pat. No. 4,434,564 A Braggins, Jr.; John C.

Examiner's Conclusions; Discloses a housing apparatus for receiving lint exhausted from a clothes dryer.

Applicant response; The Braggins invention; An exhaust heat recovery apparatus for clothes dryers and the like, comprising: an enclosed chamber having an inlet port for receiving exhausted air from a clothes dryer, and an indoors exhaust opening through which the dryer exhaust air is discharged into the interior environment of the home; and scrubber means within said chamber for removing lint from the exhausted dryer air prior to discharging said air through said indoors exhaust opening.

A heat recovery device is adapted for placement in the heat exhaust vent pipe of a conventional clothes dryer. The device includes a scrubber for primary removal of lint from the dryer exhaust and a final filter means for removing small particles of lint remaining prior to allowing the warm, humid dryer exhaust air to pass into the atmosphere of the interior environment of a home.

Additionally, the Braggins invention does not address separating falling condensate from incoming lint within a clothes dryer vent system and the separate disposal of each.

application Ser. No. 15/530,561 diverts and removes falling condensate to a dedicated condensate drain within an exhaust vent system, thus preventing contact and blending of falling condensate with incoming lint and preventing falling condensate drainage into a clothes dryer.

(E) U.S. Pat. No. 4,969,276 A Walsh; Robert

Examiner's Conclusions; Discloses a housing apparatus for receiving lint exhausted from a clothes dryer.

Applicant response; The Walsh invention; an air filter and humidifier attached to the back of a clothes dryer, adapted to be connected between the upstream and downstream exhaust ducts of a clothes dryer for conditioning Its air exhaust comprising; an enclosure, a water container having an open upper end within the enclosure, routing means within the enclosure for receiving the air exhaust of a clothes dryer and directing it obliquely toward the open end of the water container.

The Walsh invention Is attached to the dryer for directing dryer exhaust airflow toward the open upper end of the water container to humidify and filter the exhaust air.

Additionally, the Walsh invention does not address separating falling condensate from incoming lint within a clothes dryer vent system and the separate disposal of each.

application Ser. No. 15/530,561 diverts and removes falling condensate to a dedicated condensate drain within an exhaust vent system, thus preventing contact and blending of falling condensate with incoming lint and preventing falling condensate drainage into a clothes dryer.

(F) U.S. Pat. No. 6,189,228 B1 Schuette; Lyle

Examiner's Conclusions; Discloses a housing apparatus for receiving lint exhausted from a clothes dryer.

Applicant response; The Schuette Invention; An improved heat recycler, for use with a dryer, which is able to direct warm moist air that has been expelled by a clothes dryer either into a dwelling, or direct the air outside of the dwelling, comprising; a dryer support upon which a clothes dryer is able to be set so that a dryer vent hose may be placed, an interior discharge vent opening, a valve assembly, positioned within the dryer support, a valve flap, contained within the valve assembly.

This Schuette invention relates to directing the dryer exhaust airflow to either into the dwelling or to the outside. The dryer is elevated onto a base which houses the discharge diverter to allow dryer exhaust airflow to optionally exit under the dryer.

Additionally, the Schuette invention does not address separation of falling condensate from dryer produced lint within a clothes dryer vent system and the separate disposal of each.

application Ser. No. 15/530,561 diverts and removes falling condensate to a dedicated condensate drain within an exhaust vent system, thus preventing contact of falling condensate with incoming lint and preventing falling condensate drainage into a clothes dryer.

(G) US-2002/0023368 A1 Beaumont, Bart Donald

Examiner's Conclusions; Discloses a housing apparatus for receiving lint exhausted from a clothes dryer.

Applicant response; The Beaumont invention; A lint collector and safety system for the exhaust of a clothes dryer, comprising: a housing, said housing having an inlet and an outlet for passage of exhaust air from the dryer, said inlet being adapted for attachment to dryer, said housing having a water reservoir, wherein the inlet Is disposed such that the exhaust air from the dryer is directed onto the surface of water in the water reservoir.

This Beaumont invention is based on water within a water reservoir to collect lint rather than a dry double filter.

Additionally, the Beaumont invention does not address separating falling condensate from incoming lint within a clothes dryer vent system and the separate disposal of each.

application Ser. No. 15/530,561 diverts and removes falling condensate to a dedicated drain within an exhaust vent system, thus preventing contact of falling condensate with incoming lint and preventing falling condensate drainage into a clothes dryer.

(H) US-2011/0167662 A1 Dittmer; Lothar

Examiner's Conclusions; Discloses a dryer comprising exhaust airflow diverter and condensate separator with condensate outlet port.

Applicant response; The Dittmer invention; A dryer, comprising: a drying chamber to receive damp items; a process air duct to feed process air into the drying chamber and to extract process air from the drying chamber, the process air duct having a heat source to heat processed air before the process air enters the drying chamber and a heat sink to cool the process air after the process air leaves the drying chamber;

This Dittmer invention relates to a dryer comprising a drying chamber to accommodate damp items to be dried and an essentially closed process air duct to circulate process air through the drying chamber. The Dittmer invention is located within a dryer, not within a clothes dryer vent system.

Additionally, the Dittmer invention does not address separation of falling condensate from dryer produced lint within a clothes dryer vent system and the separate disposal of each.

application Ser. No. 15/530,561 diverts and removes falling condensate to a dedicated drain within an exhaust vent system, thus preventing contact of falling condensate with incoming lint and preventing falling condensate drainage into a clothes dryer.

SUMMARY OF THE INVENTION

This invention has particular application to homes and other dwellings allowing architects, builders and contractors greater leeway in designing more efficient utility room combinations. Clothes dryers may be positioned for best use of floor space while providing a higher degree of fire safety within the homes.

In accordance with the present invention, the unrestricting airflow filter, condensate and lint particulate separator apparatus within a housing of a gaseous fluid exhaust system provides multiple unique features within a clothes dryer's exhaust system.

A primary object of the invention is to remove excess lint particulate from the exhaust airflow by filtration before the rising exhaust airflow comes in contact with falling condensate.

Another primary object of the invention is to filter and remove the lint particulate originating from a clothes dryer's exhaust airflow, to prevent lint particulate from blending with falling condensate, which can form within a gaseous fluid exhaust system, and to prevent the falling condensate from entering the clothes dryer, and to dispose the falling condensate out of the gaseous fluid exhaust system to a designated drain.

The filtered exhaust airflow, continues through the non-restricting airflow channel and is separated from the falling condensate within a diverter and is directed to one of two exit outlets as selected by the clothes dryer operator.

The exhaust airflow is directed to a selected outlet within a diverter apparatus by blocking exhaust airflow to the unselected outlet and directing the exhaust airflow to exit through the selected outlet.

The airflow diverter additionally channels exhaust airflow upward past falling condensate creating a separation of the upward flowing exhaust airflow and the downward flowing condensate within the shared confinement of the diverter and exhaust outlet.

It is another object of the invention to provide an operational zone located in the upper compartment of the housing for placement of operational components comprising; access openings, viewing windows, an airflow diverter, and an airflow monitor/alarm.

It is another object of the invention to provide access openings for entry into the housing for cleaning and maintenance, additionally, the access openings are sealable with removable clear viewing panels that serves as observation windows for monitoring conditions during normal operations. The access openings and viewing windows are located within the operational zone for efficient operations and accessibility.

It is another primary object of the invention to provide an enlarged removable double screen exhaust unrestricting airflow filter with a folding design to fit into a filter pocket within the housing at a downward angle to provide additional filter surface.

It is another object of the invention to segregate the exhaust airflow from falling condensate, to direct the exhaust airflow to one of two designated exhaust outlets and direct the falling condensate to a separate dedicated condensate outlet for disposal.

It is another object of the invention to provide falling condensate filtration with a removable, cleanable, air blocking screen to prevent contaminates from entering a drain system.

It is another object of the invention to prevent falling condensate from entering a clothes dryer by exhaust airflow upward force directing falling condensate towards and into the condensate drain.

It is another object of the invention to block entry of exhaust airflow into the condensate drain with an inverted drain loop (trap) which holds an amount of fluid so as to block downward entry of the exhaust airflow into the condensate drain.

It is another object of the invention to provide a toxic gas trap as part of the condensate drain for preventing upward entry of sewer gasses into the gaseous fluid system. The toxic gas trap comprises a drain loop (trap) which holds an amount of fluid so as to block upward entry of sewer gasses.

It is another object of the invention for the housing to be installed onto finished gypsum wall board surface of a room.

It is another object of the invention to provide continuous unrestricted airflow within the housing being dimensioned to be 3.5 inch depth, to accommodate interior wall installations of the housing. Airflow received from a 4 inch round (12.56 sq. inch) clothes dryer vent is converted to a 3.5 inch by 4 inch (14 sq. inch) or larger rectangular passageway for unrestricted airflow through the housing.

Within the housing, airflow passageway capacity equals or exceeds 100% of airflow capacity produced by the clothes dryer's 4 inch round flexible vent pipe. It is another object of the invention to provide an airflow monitor/alarm to record and signal any issues arising from overheating, reduced airflow volume or increased airflow pressure within the exhaust airflow system resulting from blockage due to build-up of lint particulate, condensate or their blending into a slurry.

It is another object of the invention to provide containment of the flexible exhaust pipe within the lower storage compartment of the housing with a moveable retaining gate for securing the flexible exhaust pipe in multiple non-kinking positions for storage and efficient connections to the clothes dryer exit pipe.

It is another object of the invention to provide positioning of the airflow filter, condensate filters, airflow diverter, access openings and observation windows in the operational zone for easy accessibility.

To the accomplishment of the foregoing and related ends, the invention, then, comprises the features here. The present invention in after fully describe and particularly pointed out in the claims, the following description and the annexed drawings setting forth in detail certain illustrative embodiments of the invention, these being indicative, however, of but some of the various ways in which the principals of the invention may be employed.

It is a further object of the invention to provide improved elements and arrangements thereof for the purposes described which is inexpensive, dependable and fully effective in accomplishing its intended purposes.

These and other objects of the present invention will become readily apparent upon further review of the following specifications and drawings.

BRIEF DESCRIPTION OF THE DRAWINGS

There are shown in the drawings embodiments which are presently preferred, it being understood, however, that the invention is not limited to the precise arrangements and instrumentalities shown, wherein.

Figure 1:
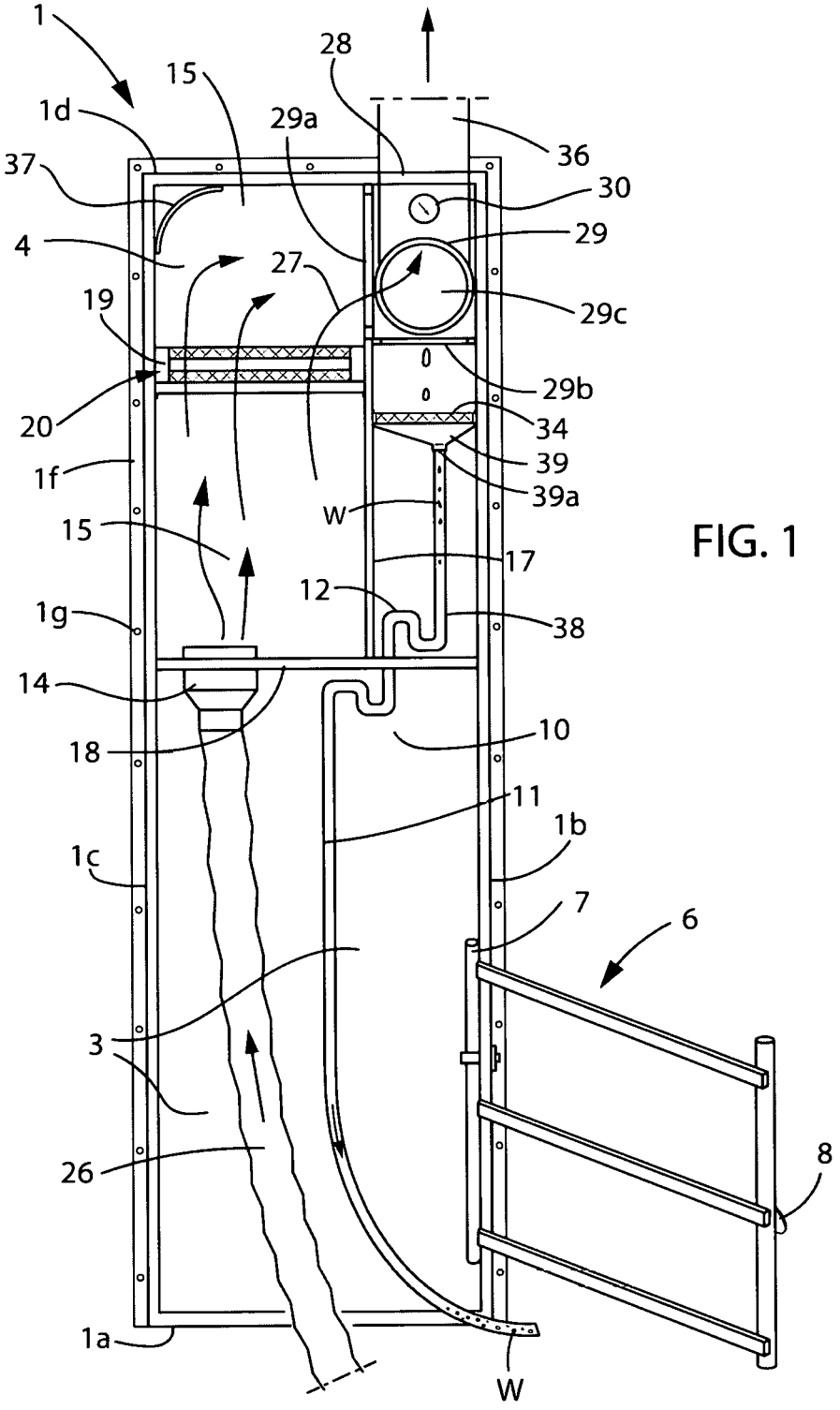
FIG. 1 is a front elevation view of the unrestricted airflow housing 1 of this invention with the upper compartment open, revealing exhaust airflow 27 from a clothes dryer entering through the inlet vent pipe 26 and continuing through the exhaust airflow diverter 29 and exiting through the airflow outlet pipe 36.

Exhaust airflow 27 enters the diverter inlet port 29*g* and is directed by the second airflow directional guide 37*a* to the first outlet port 29*d* or to the second outlet port 29*c* subject to placement of the damper door 29*f*.

A weep-hole 28 is located on a sloped shelf 29*h* and is open to receive falling condensate "W" drainage from the airflow outlet pipe 36.

Falling condensate "W", which forms in the airflow outlet pipe 36, is forced against the further side wall of an airflow hood 36*b* of the exhaust airflow diverter 29 by the upward and lateral pressure of the exhaust airflow 27 entering the exhaust airflow diverter 29 from the diverter inlet port 29*g*.

The falling condensate "W" continues to flow downward through the weep-hole 28 of the airflow diverter 29 into the condensate port 29*b*.

The inlet port 29*g*, primary outlet port 29*d* and secondary outlet port 29*c* are a rectangular 3.5 inch by 4 inch or larger configuration to provide an unrestricting airflow passage from the 4 inch round inlet vent pipe 26.

A 3.5 inch by 4 inch (14 sq. inch) or larger airflow channel 15 within the housing 1 exceeds the volume of the 4" round (12.56 sq. inch) inlet vent pipe 26 resulting in no airflow restrictions. The housing 1 provides an unrestricting exhaust airflow 27 design throughout for efficient passage of exhaust airflow 27, which originates from a clothes dryer "D".

Exhaust airflow 27 can be directed to either the primary outlet port 29*d* or to the secondary outlet port 29*c* by blocking the unselected outlet port with the moveable damper door 29*f*. The hood 36*b* serves to connect the airflow diverter 29 to the outlet pipe 36 and guide the exhaust airflow 27 upward and laterally to force the falling condensate "W" away from the primary outlet port 29*d* and toward the weep-hole 28 creating a separation of rising exhaust airflow 27 and falling condensate "W" within the airflow diverter 29.

A separation wall 29*i* segregates the weep-hole 28 from the airflow channel 15 to prevent exhaust airflow 27 from entering the eccentric condensate port 29*b* and additionally preventing condensate "W" from entering the diverter inlet port 29*g*, the primary outlet port 29*d* or the secondary outlet port 29*c*.

The separation wall 29*i* extends down but not connecting with the diverter floor 29*j* leaving a clearance gap 29*m* for water drainage from the airflow channel 15 which results from inadvertent water overflow into the airflow channel 15 of the airflow diverter 29.

The airflow diverter 29 has a diverter floor 29*j* that is slanted downward towards the eccentric condensate port 29*b* to allow inadvertent condensate water "W" to flow from the airflow chamber 15 through the clearance under the separation wall 29*i* into the condensate port 29*b*.

Figure 4:
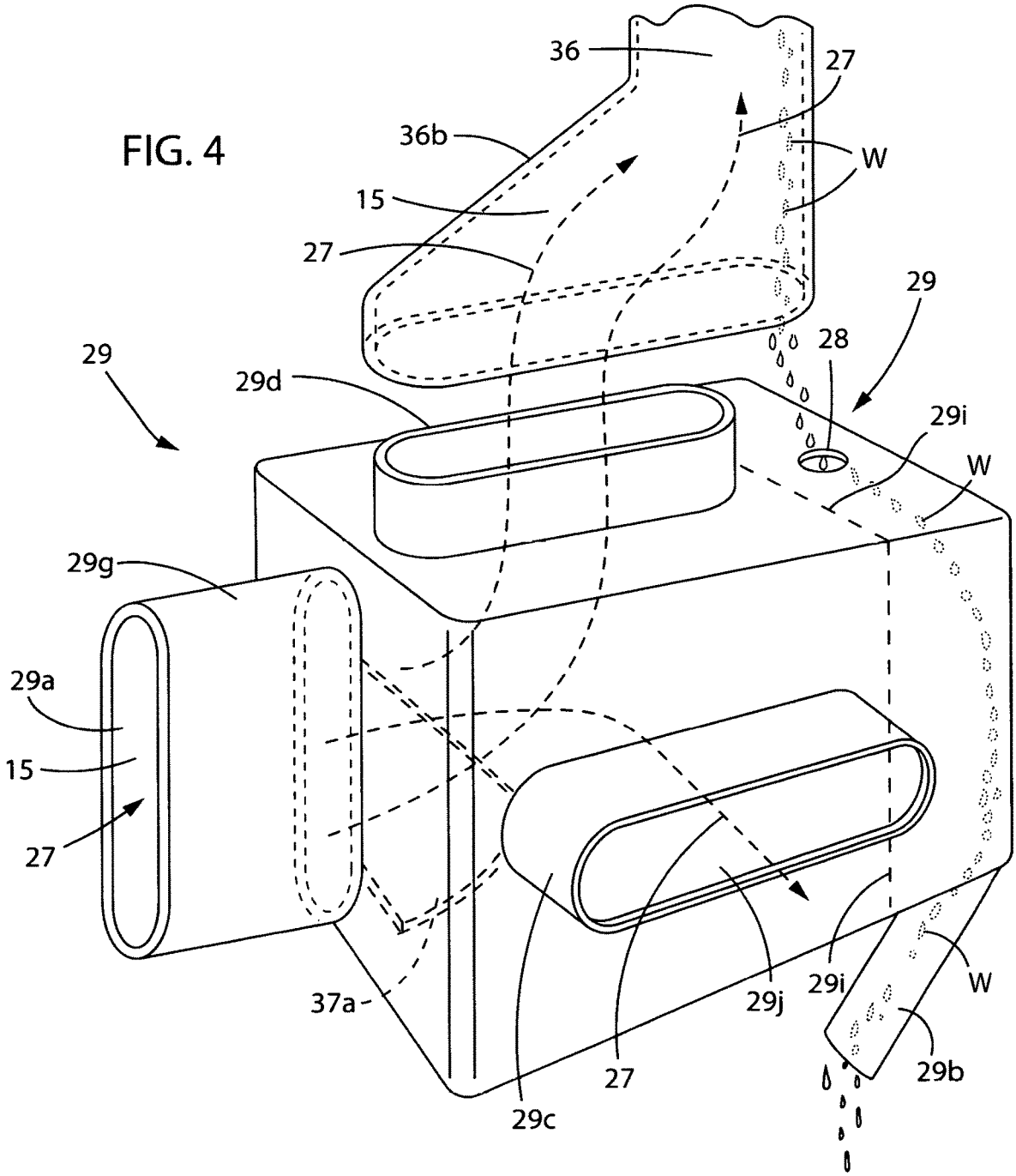
FIG. 4 is a perspective view illustrating the exhaust airflow diverter 29.
Figure 5:
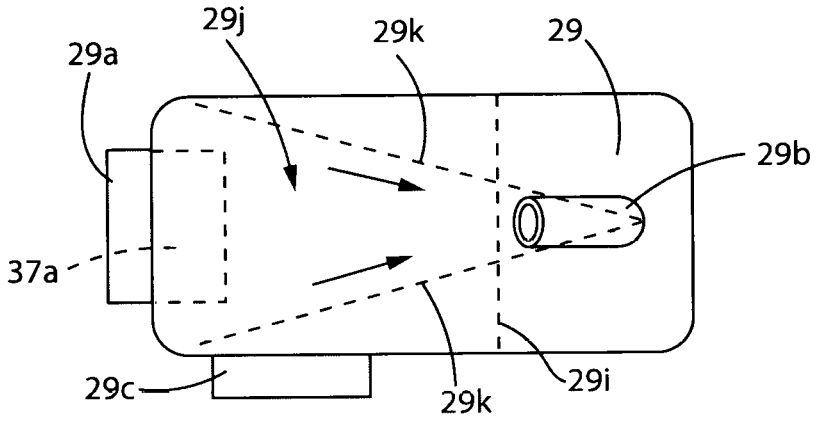

FIG. 5 shows the bottom view of the unrestricting airflow diverter 29 illustrating the eccentric condensate drain 29*b*, diverter airflow channel 29*a*, second outlet port 29*c* and second airflow directional guide 37*a* as illustrated in FIG. 4.

Additionally, the sloped diverter floor 29*j* is illustrated with the sloped floor valleys 29*k* to allow drainage to the eccentric condensate port 29*b*.

Figure 6:
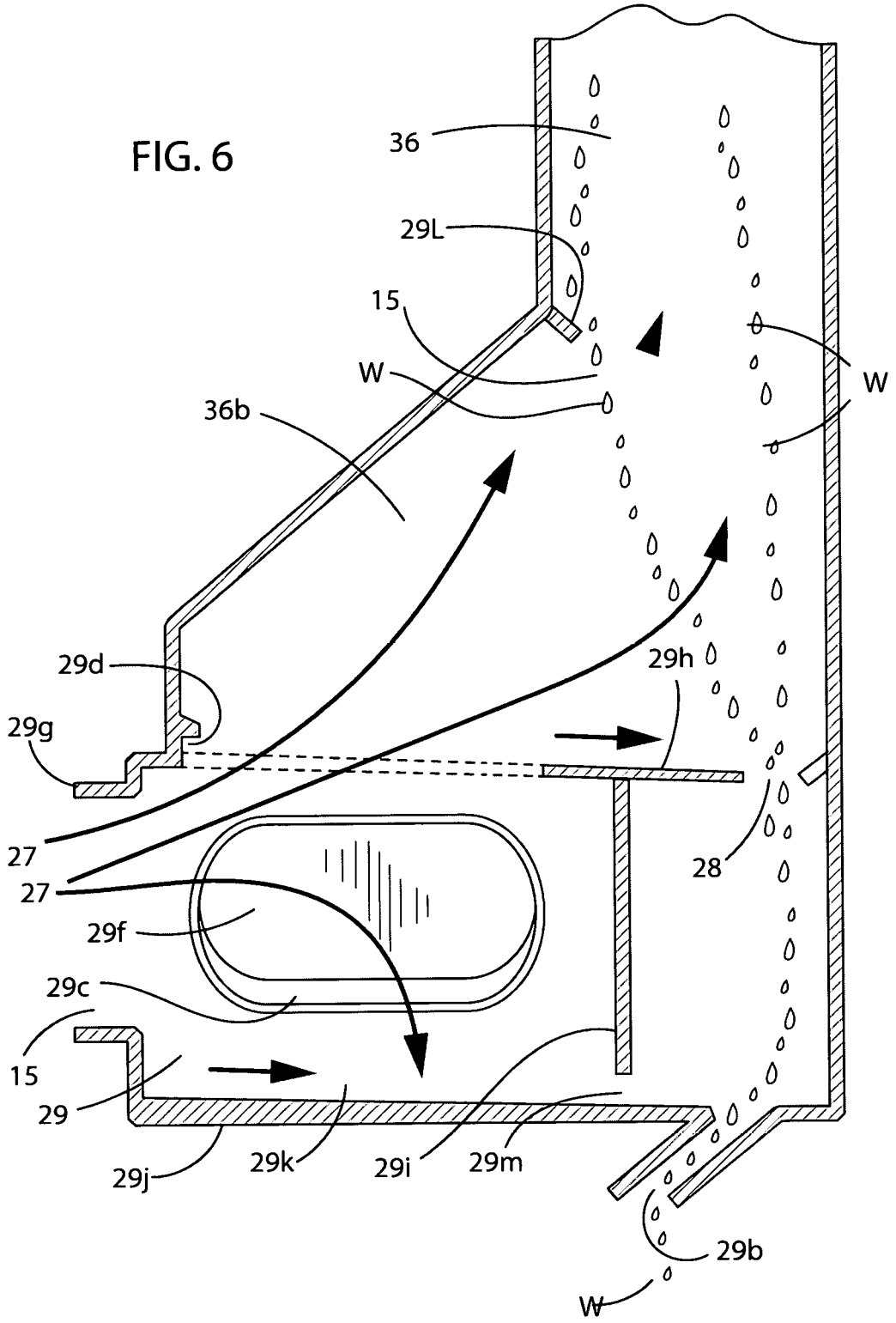

FIG. 6 illustrates the unrestricting airflow diverter 29 with the airflow hood 36*b* communicating exhaust airflow 27 into the primary outlet port 29*d* and into the outlet pipe 36 when the damper door 29*f* is positioned to block airflow through the secondary exhaust port 29*c*.

The exhaust airflow 27 current forces the condensate "W" away from the diverter inlet port 29*g* preventing condensate "W" entry.

Falling condensate "W" from the airflow hood 36*b* is directed to the weep-hole 28 by the sloped shelf 29*h* and the airflow current force produced by the exhaust airflow 27 current passing through the diverter inlet port 29*g*.

After passing through the weep-hole 28, the condensate water "W" is separated from the exhaust airflow 27 by the separator wall 29*i* which extends downward close to but not touching the diverter floor 29*j*, which allows inadvertent water "W" to flow under the separator wall 29*i* through the clearance gap 29*m* to exit through the eccentric condensate port 29*b*.

Figure 7:
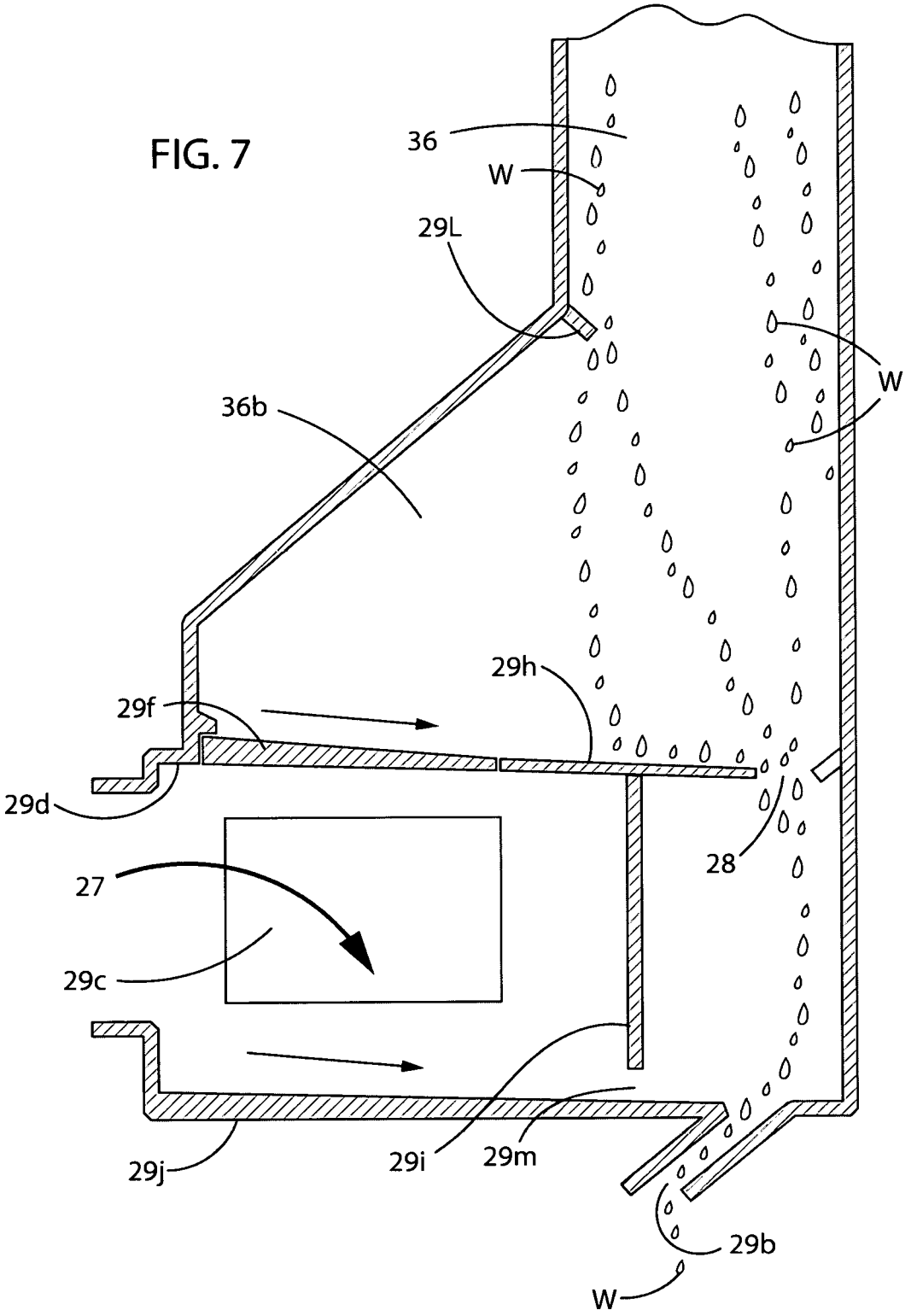

FIG. 7 illustrates the unrestrictive airflow diverter 29 with the damper door 29*f* in the upward position closing off the primary outlet port 29*d* to direct exhaust airflow 27 through the secondary outlet port 29*c*.

The top surface of the damper door 29*f* is sloped toward the sloped shelf 29*h* to direct water to the weep-hole 28.

Additionally, a drip edges 29L are positioned inside the airflow hood 36*b* to direct falling condensate water "W" towards the slanted shelf 29*h* and towards the weep-hole 28.

Additionally, the diverter floor 29*j* has a sloped top surface to direct any inadvertent water through the clearance gap 29*m* towards the drain 29*b*.

Figure 8:
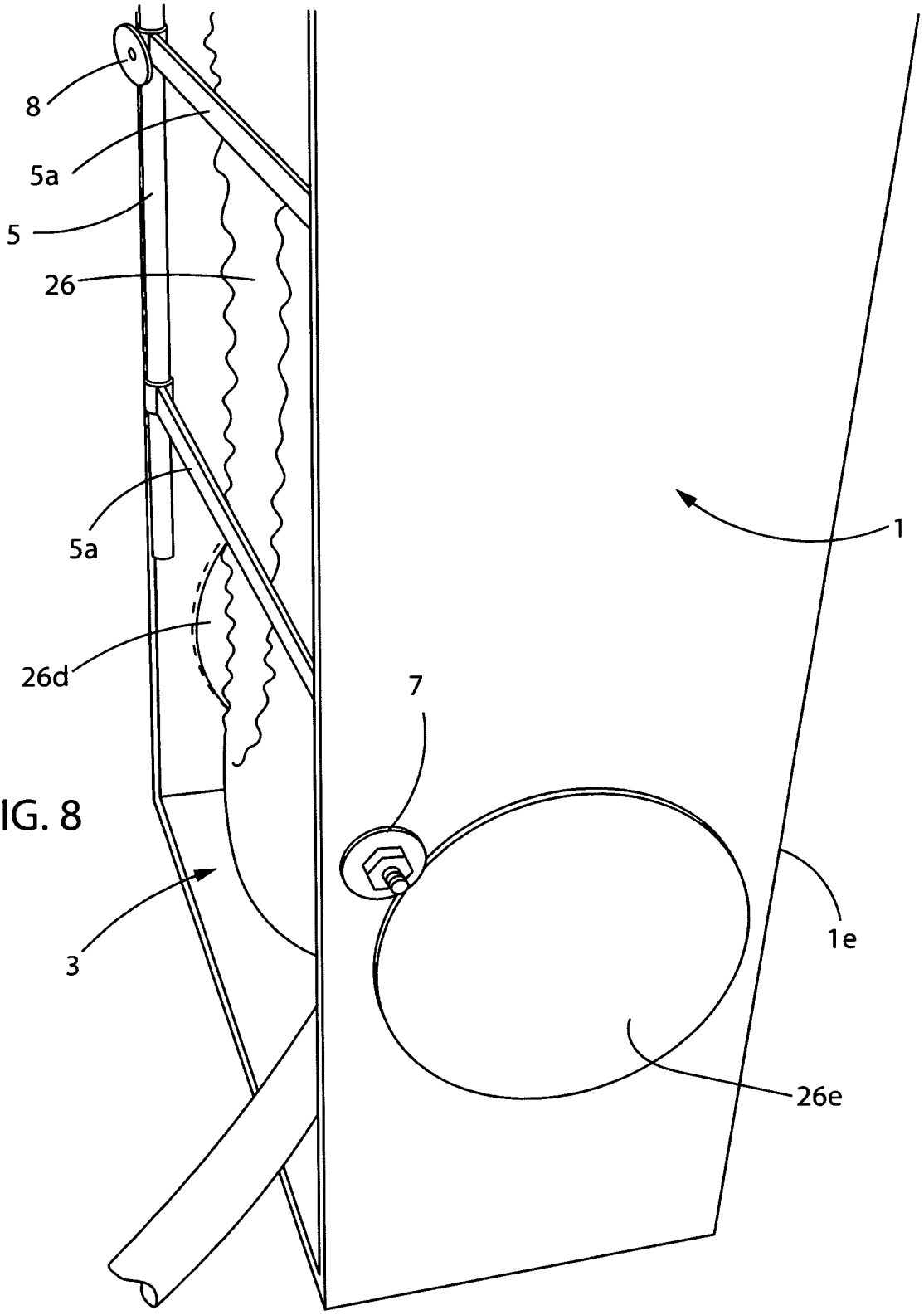

FIG. 8 is a perspective view of the open lower compartment 3 of the housing 1 with the closed gate 5 and the side wall knockouts 26*d* and 26*e* illustrated. The side wall knockouts 26*d* and 26*e* allow for an alternate inlet vent pipe

26 exit points. The rear wall 1*e* of the housing 1 illustrates the typical configuration of the housing 1.

Figure 9:
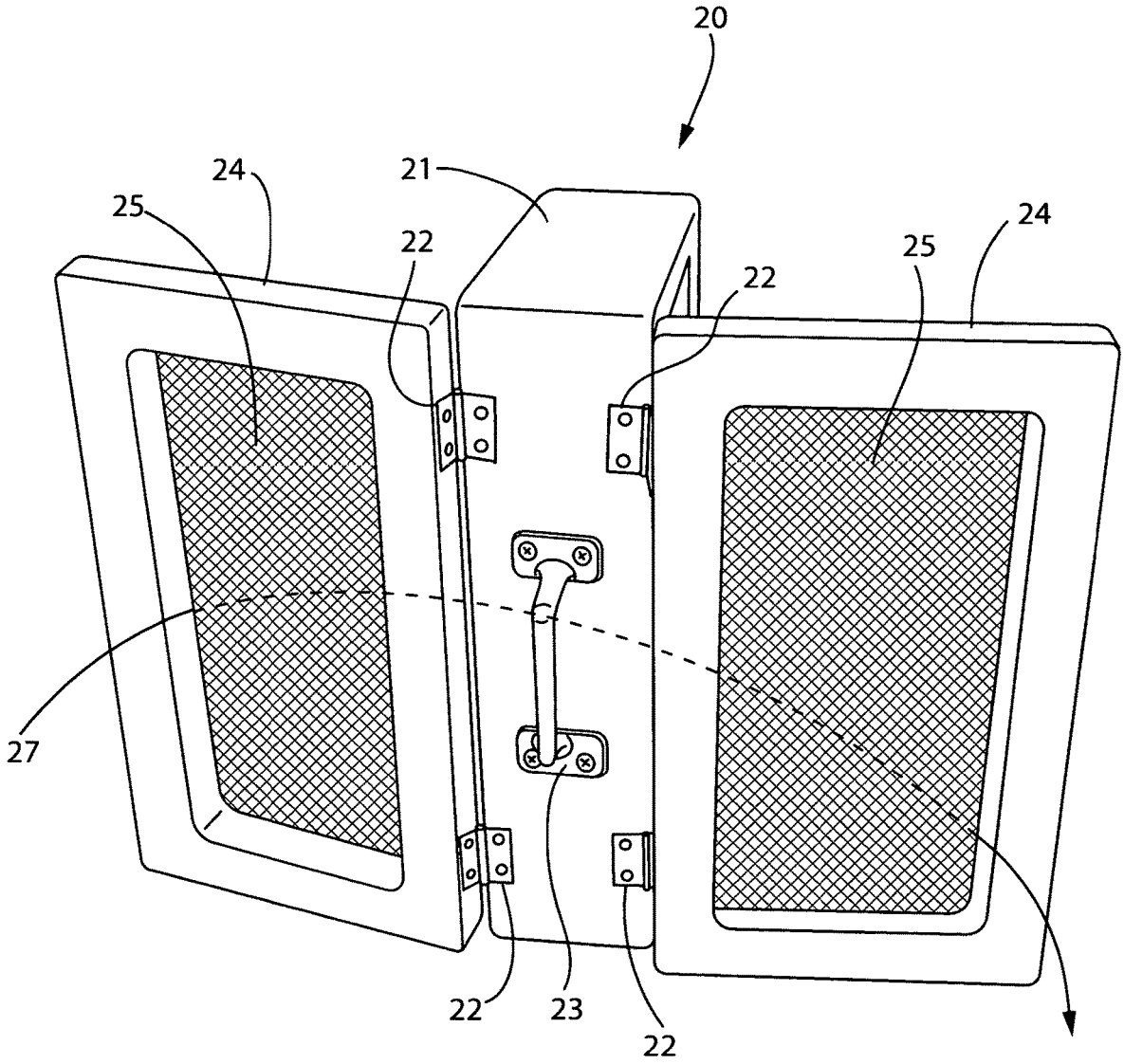

FIG. 9 is a perspective view of the unrestrictive airflow double filter unit 20 in the open position for cleaning. The airflow filter frame 21 comprises the filter screen holder 24, double filter screens 25, frame hinges 22, and frame handle 23. This inward folding configuration allows additional filter screen 25 surface to provide additional exhaust airflow 27 passage. Lint laden exhaust airflow 27 passes through filter screens 25 to provide substantially lint free exhaust airflow 27.

Figure 2:
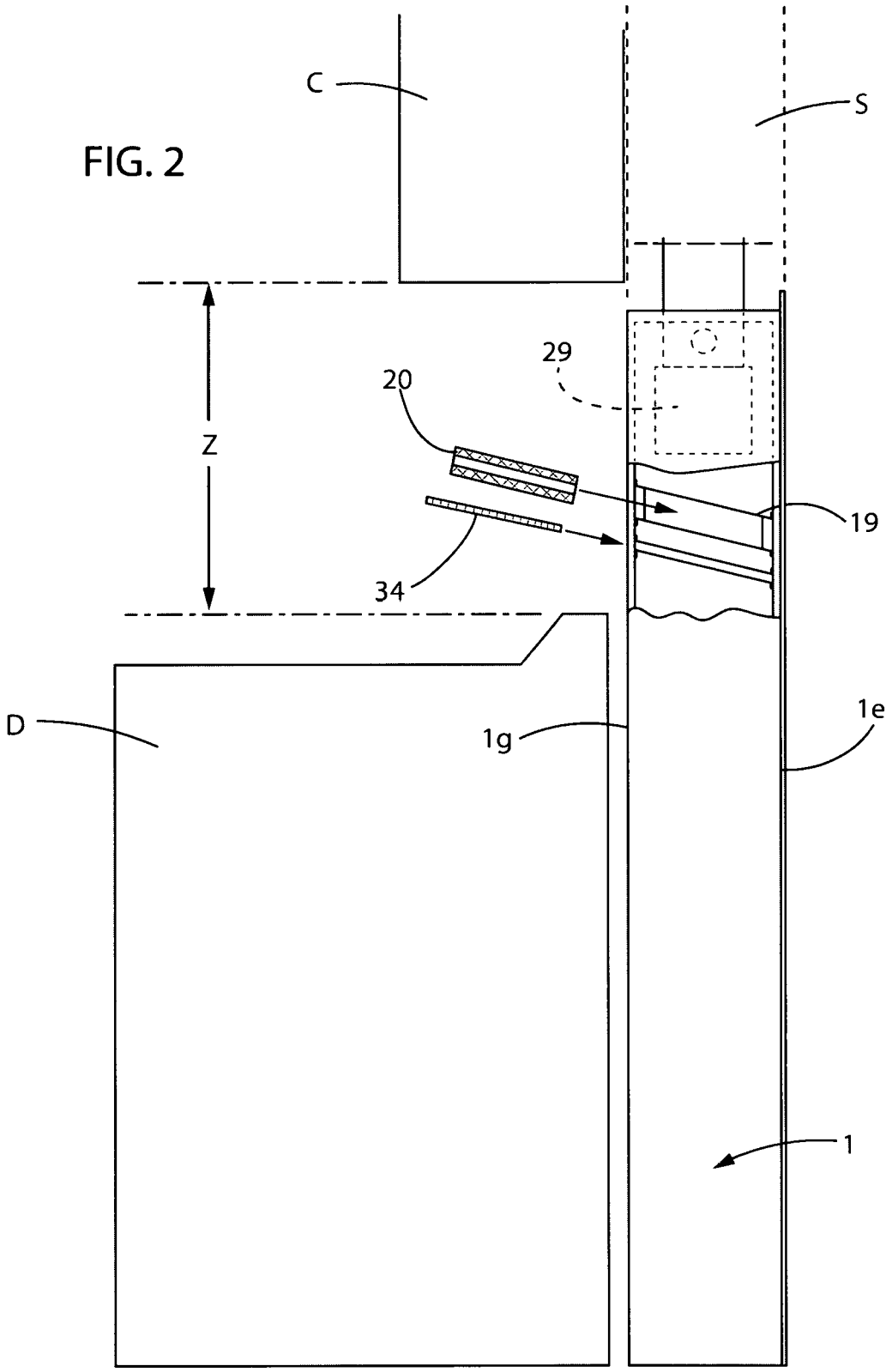
FIG. 2 is a side elevation view of the housing 1 revealing the removable unrestricting airflow double filter 20, removable condensate filter 34. Illustrated is the housing placement within a stud wall S, additionally, placement of the clothes dryer D, and placement of the wall cabinets C. The operational zone Z above the dryer and cabinets provides an area for easy reach to the removable filters. Monitor 30 and diverter 29 by the operator.
Figure 10:
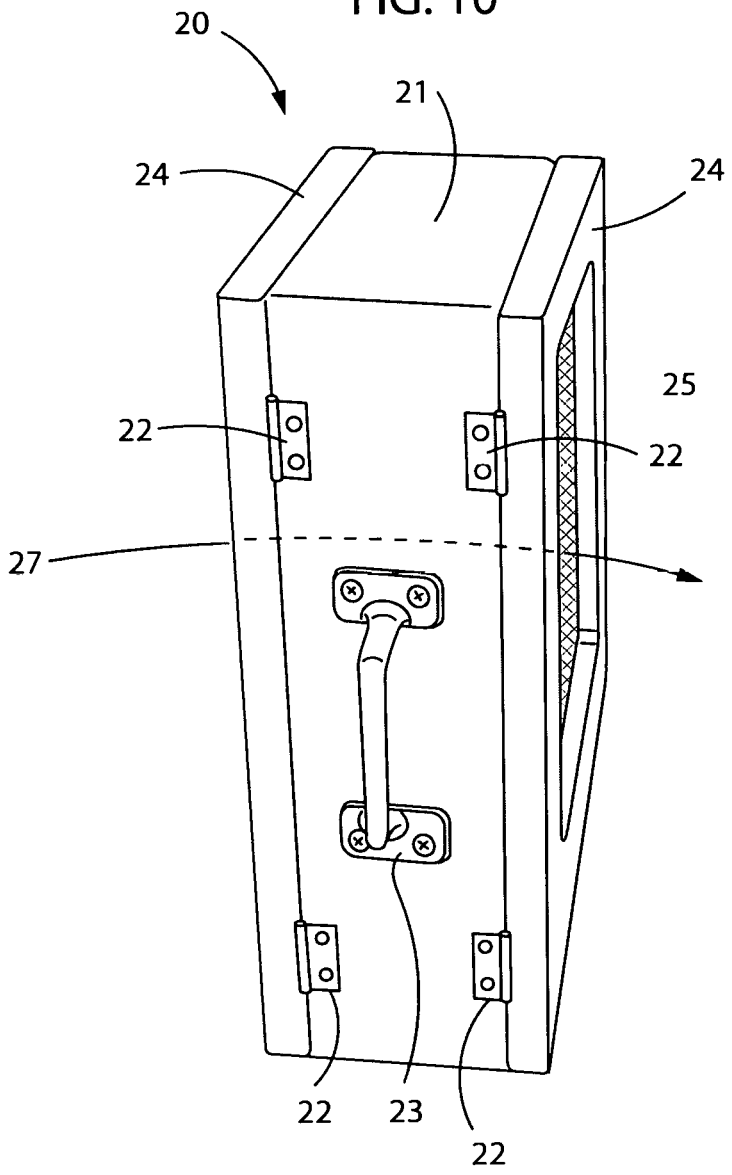

FIG. 10 illustrates the unrestrictive airflow double filter unit 20 in the closed position with the exhaust airflow 27 path through the double screens 25. This configuration represents the operational position of the airflow filter 20 as illustrated in FIG. 1 and FIG. 2.

Figure 11:
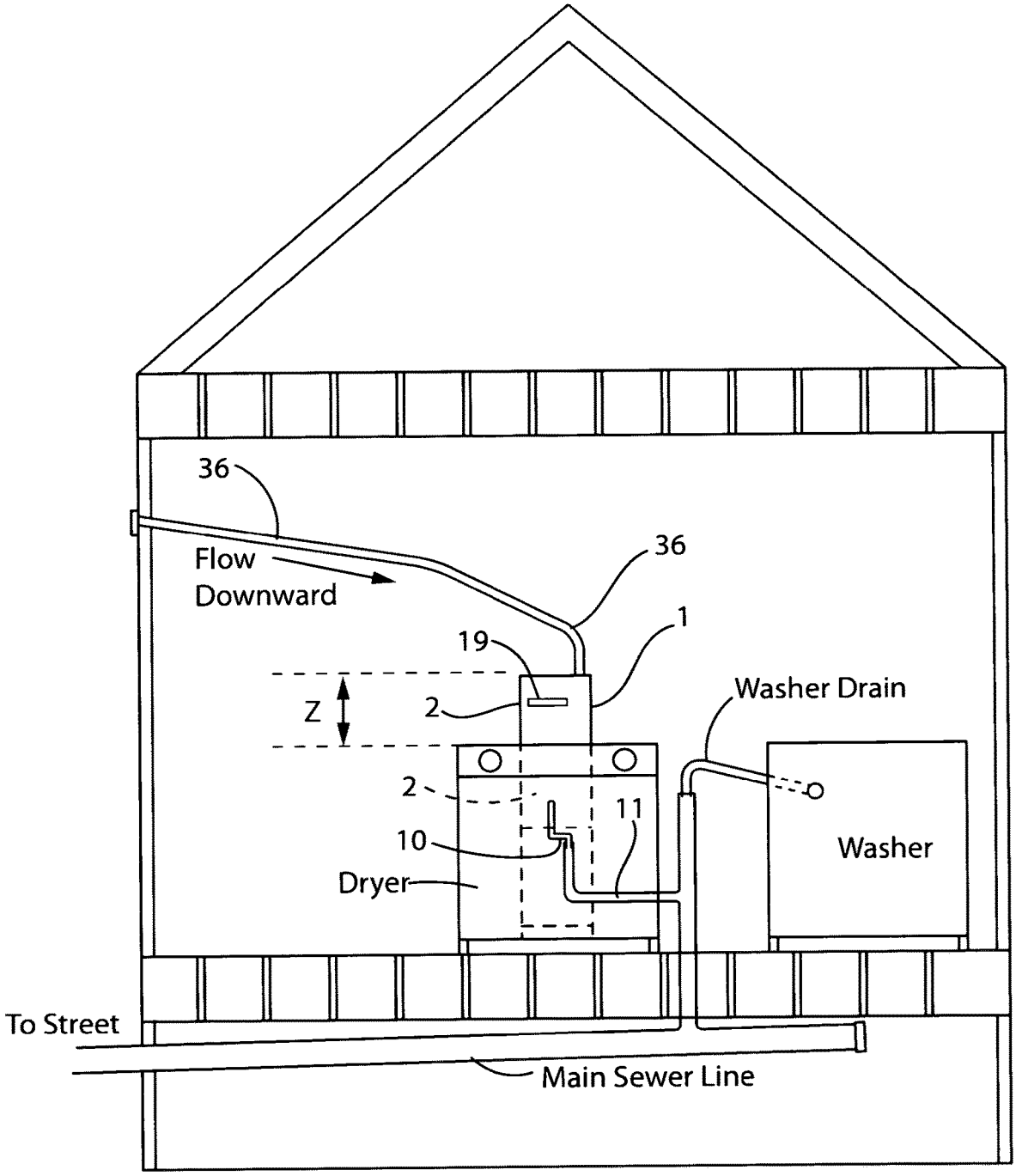

FIG. 11 is an illustration of the unrestrictive housing 1 positioned behind the clothes dryer with the condensate drain pipe 11 connected to a washer drain for draining away condensate. The airflow outlet pipe 36 must be at a constant downward or constant upward grade to the housing 1 to prevent inadvertent water traps which can block exhaust airflow.

The operational zone "Z" above the dryer top is shown to illustrate the accessibility to reach the removable filters and the access openings. Additionally, the exhaust pipe 36 is shown to have a continuous slope to eliminate any water traps that could fill with condensate "W".

Figure 12:
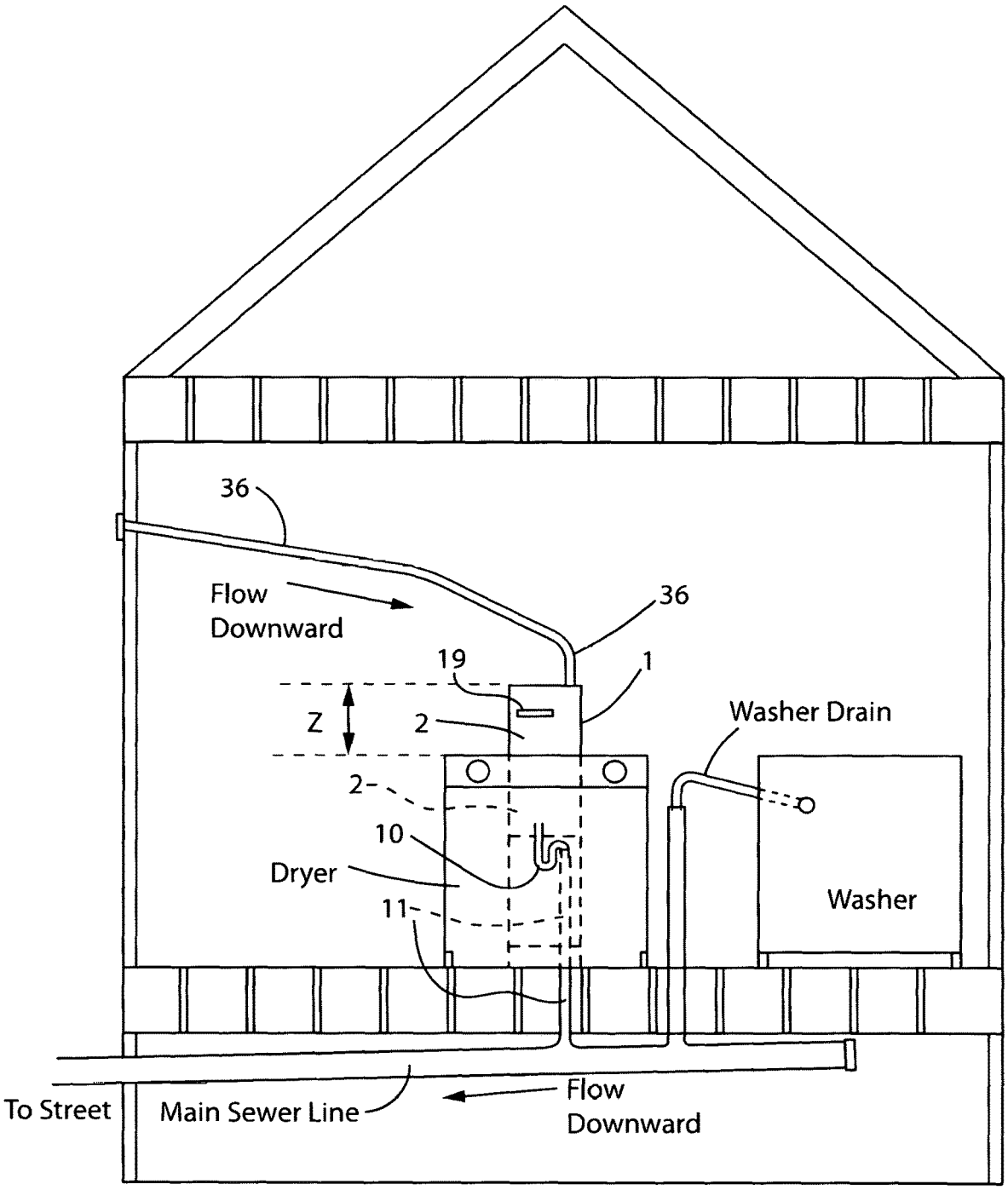

FIG. 12 is an illustration of the unrestricting housing 1 positioned behind the clothes dryer with the condensate drain pipe 11 connected to a main sewer line for draining away condensate. The airflow outlet pipe 36 must be at a constant downward or constant upward grade to the housing 1 to prevent water traps which can block exhaust airflow. The operational zone "Z" is illustrated above the Dryer for easy access.

Figure 13:
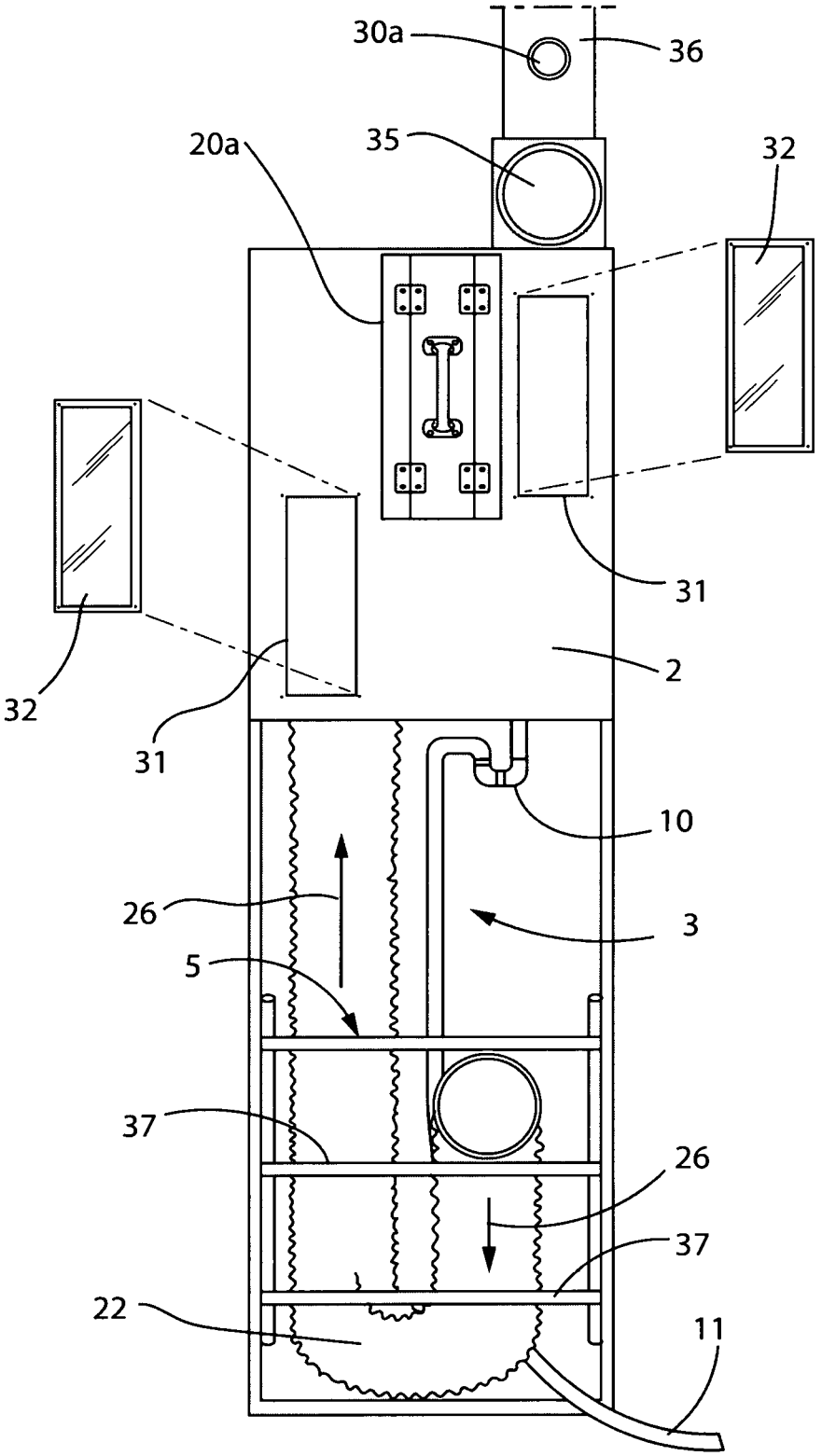

FIG. 13 is an additional embodiment of the housing 1. Illustrating the alternative unrestricting airflow filter 20*a* in a vertical configuration, additionally the alternative airflow monitor/alarm 30*a* is positioned within the airflow outlet pipe.

LIST OF FIGURES

1. Housing (unrestricted airflow)
1*a*. Bottom wall
1*b*. Right side wall
1*c*. Left side wall
1*d*. Top wall
1*e*. Rear wall
1*f*. Attachment flange
1*g*. Attachment holes
2. Front wall upper compartment
3. Lower compartment
4. Upper compartment
5. Retaining gate closed
5*a*. Moveable cross members
6. Retaining gate open
7. Retaining gate hinge
8. Retaining gate latch
10. Toxic gas trap
11. Condensate drain trap
12. Airflow drain trap
13. - - - -
14. Inlet pipe connector, circular to rectangular
15. Unrestrictive airflow channel
16. - - - -
17. Divider wall
18. Upper compartment floor
19. Filter receiving pocket
20. Unrestricting airflow filter unit
20*a*. Alternative vertical unrestricting airflow filter unit configuration
21. Airflow filter frame
22. Airflow filter frame hinges
23. Airflow filter frame handle
24. Airflow filter screen holder
25. Unrestrictive airflow filter screens
26. Flexible inlet vent pipe, 4 inch round
26*a*. Vent pipe upper position
26*b*. Vent pipe mid position
26*c*. Vent pipe lower position
26*d*. Left knockout
26*e*. Right knockout
27. Exhaust airflow
28. Condensate weep hole
29. Exhaust airflow diverter-condensate separator
29*a*. Unrestricted lateral airflow channel
29*b*. Eccentric condensate drain
29*c*. Unrestricted secondary outlet port
29*d*. Unrestricted primary outlet port
29*e*. Damper door handle
29*f*. Damper door
29*g*. Unrestricted diverter inlet port
29*h*. Sloped shelf
29*i*. Separator wall, not touching floor
20*j*. Sloped diverter floor
29*k*. Sloped floor valleys
29*l*. Drip-edges
29*m*. Clearance gap
30. Airflow monitor/alarm
30*a*. Alternative airflow monitor/alarm configuration
31. Access openings
32. Removable windows
33. Window frames
34. Unrestricted condensate filter
35. Alternative airflow diverter configuration
36. Unrestricted airflow outlet pipe
36*b*. Unrestricted airflow hood
37. First airflow directional guide
37*a*. Second airflow directional guide
38. Condensate connector pipe
39. Condensate funnel pan
39*a*. Condensate funnel pan drain
C. Wall cabinet
D. Clothes dryer
S. Wall studs
W. Condensate water
Z. Operational zone

DETAILED DESCRIPTION OF THE PREFERRED EMBODIMENTS

Throughout the following specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive sense.

The preferred embodiment of the invention is shown in FIGS. 1 thru 13.

FIG. 1, depicts a front elevation view of the housing 1 within a gaseous fluid exhaust system, the housing 1 includes a bottom wall 1*a* as a floor, the housing 1 includes two side walls, right side wall 1*b* and left side 1*c* connected to the bottom wall 1*a*, the housing 1 has a top wall 1*d* connected to the side walls 1*b* and 1*c*, the housing 1 has a rear wall 1*e*, FIG. 2 connected to the bottom wall 1*a*, side walls 1*b* and 1*c* and the top wall 1*d*.

The bottom wall 1*a*, side walls 1*b* and 1*c*, rear wall 1*e* and top wall 1*d* provide structural support for the housing 1. An upper compartment front wall 2, FIG. 12 provides a substantially airtight enclosure for the upper, substantially airtight compartment 4.

To permit installation into the cavity of a typical framing wall, the housing 1 includes a mounting flange 1*f* which extends outwardly from the front periphery of walls 1*b*, 1*c*, & 1*d* and is cop-planar with the plane defined by the front periphery of walls 1*b*, 1*c* and 1*d*.

The mounting flange 1*f* includes mounting structures, such as holes 1*g* which are adapted to receive mounting screws to secure the housing 1 to a wall surface. Within the housing 1, a divider wall 17 separates an unrestricted airflow channel 15 from an eccentric condensate drain 29*b* and a condensate connector pipe 38.

The lower compartment 3 is substantially open in the front. The lower compartment 3 is separate from the closed upper compartment 4 by the upper compartment floor 18. The lower compartment 3 contains and organizes the flexible inlet pipe 26 with a closed retaining gate 6.

The retaining gate 6 is supported by gate hinges 7 and is secured in the closed position by a gate latch 8. The lower compartment 3 additionally contains the condensate drain pipe 11. The housing 1 which receives exhaust airflow 27 from a clothes dryer through the flexible hollow inlet vent pipe 26 is positioned within the lower compartment 3 and extends into the inlet pipe connector 14 located in the upper compartment floor 18 and conveys exhaust airflow 27 through the airflow channel 15 within the upper compartment 4.

Additionally, the inlet pipe connector 14 is configured to accept a 4 inch round inlet vent pipe 26 at inlet end and convert to a 3.5 inch by 4 inch rectangular configuration on its outlet end to accommodate 100% of the airflow volume conveyed from the round inlet vent pipe 26 and fit within the 3.5 inch housing 1 depth, the conversion allows the continuation of an unrestricted exhaust airflow passageway.

Located within the airflow channel 15 is a removable airflow filter unit 20 which collects lint particulate from the exhaust airflow 27.

The removable airflow filter 20 fits snugly and substantially airtight into a downward sloping airflow filter pocket 19 with the lower end being to the rear wall 1*e*, FIG. 2 of the upper cabinet 4 and the upper end of the airflow filter 20 being at the front wall FIG. 2 of the upper compartment 4, FIG. 2.

The exhaust airflow 27 conveys through the removable airflow filter 20, located within the airflow channel 15. The airflow filter pocket 19, which receives the removable airflow filter 20 is positioned within the housing 1 to be located above the top wall of a typical clothes dryer within an operational zone "Z", FIG. 2 for efficient removal and replacement of the airflow filter 20.

Within the upper compartment 4, the exhaust airflow 27, exits the airflow filter 20 and is directed by a crescent shaped airflow guide 37, located within the airflow channel 15 through a lateral airflow channel 29*a*, and into an exhaust airflow diverter 29.

The airflow diverter 29 receives the exhaust airflow 27 and a second airflow guide 37*a*, FIG. 4 directs the exhaust airflow 27 away from the eccentric condensate drain 29*b*, FIG. 4 into a primary airflow outlet port 29*d*, FIG. 4 or into a secondary airflow outlet port 29*c*, FIG. 4, directs exhaust airflow 27, FIG. 4 to a selected destination such as an alternate interior room.

Falling condensate "W", FIG. 4 from the airflow outlet pipe 36 flows down into a diverter 29, FIG. 4 and through a weep hole 28, FIG. 4 of the airflow diverter 29 and exits through an eccentric condensate port 29*b*, FIG. 4.

The falling condensate W, FIG. 4 exits the eccentric condensate port 29*b*, FIG. 4 and flows into the removable condensate filter 34. The falling condensate "W" exits the condensate filter 34 and flows into the condensate funnel pan 39 and through the condensate funnel pan drain 39*a*. Falling condensate "W" continues to drain downward through the condensate connector pipe 38, into the airflow drain trap 12 and continues through a toxic gas trap 10, the condensate "W" continues downward into the condensate drain pipe 11 to be disposed of.

An airflow monitor/alarm 30, located above the airflow diverter 29, within the operational zone "Z", FIG. 2, serves to monitor airflow conditions, particularly the measurement of pressure, volume and temperature within the gaseous fluid exhaust system.

The rectangular unrestricting airflow outlet pipe 36 is above and connected to the airflow hood 36*b*, FIG. 6, which is connected to the airflow diverter 29, which is substantially hollow and airtight. The airflow outlet pipe 36 communicates from the housing 1 to the outside atmosphere and expels the exhaust airflow 27 into the outside atmosphere.

FIG. 2 shows a side view elevation of the housing 1, illustrating the airflow filter 20 positioned to be inserted from the front into the airflow filter pocket 19, which is downward slanting to the rear wall 1*e*.

Additionally, the removable condensate filter 34 is illustrated in the downward slant position from the front towards the rear wall 1*e*.

Additionally, illustrated is the operational zone "Z", located above the top wall of a typical clothes dryer "D" and below a typical wall cabinet "C".

The operational zone "Z" includes the outside front area of the housing 1 above the clothes dryer "D" and the inside area of the upper compartment 4, FIG. 1.

Figure 3:
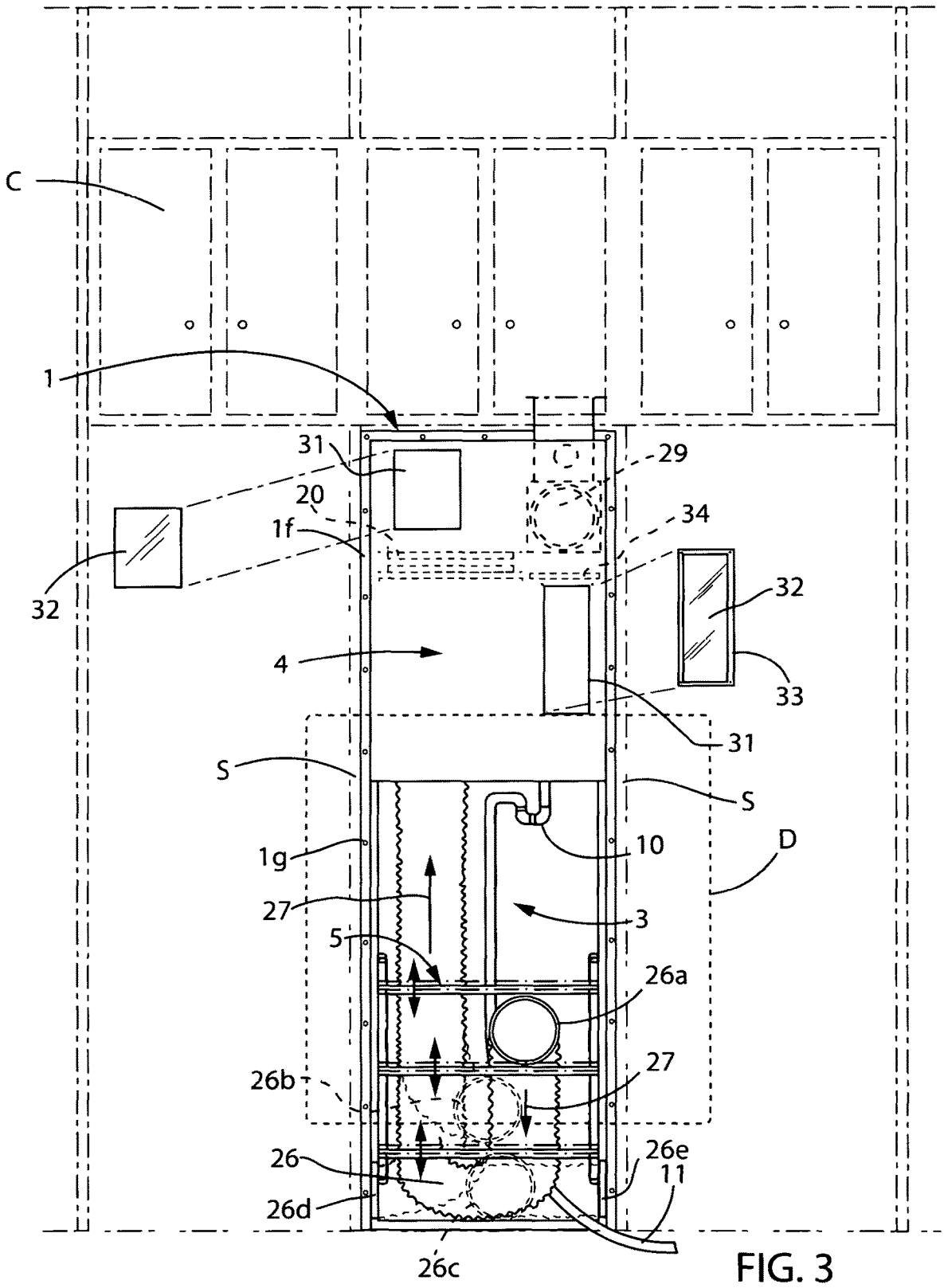
FIG. 3 is a front elevation view of the housing 1 with the upper compartment 4 enclosed revealing the preferred position of the windows 32 and access openings 31. The lower compartment 3 is substantially open in the front and illustrates the exhaust airflow 27 through the inlet vent pipe 26 which is efficiently positioned within the lower compartment 3 and secured by the moveable retaining gate 5. The clothes dryer D is positioned in front of the housing 1, wall cabinets C are positioned above and the housing 1 is positioned within wall studs S.

The location of the removable condensate filter 34, removable airflow filter 20, exhaust airflow diverter 29, access openings 31, FIG. 3 and removable windows 32, FIG. 3 are located within the operational zone "Z" for convent accessibility. The downward slope to the rear wall 1*e* allows added depth of the removable airflow filter 20 and the condensate filter 34 for increased screen area for additional filtration capacity. The housing 1 is illustrated to be installed within a stud wall "S" for efficient conservation of space.

FIG. 3, illustrates a front elevation view of the housing 1 fitting snugly within a typical wall frame between existing studs "S". Above the housing 1 is a typical wall cabinet "C" and in front of the housing 1 is a typical clothes dryer "D".

The flexible inlet vent pipe 26, conveys the exhaust airflow 27 and is efficiently stored within the open lower compartment 3 and is positioned to turn and exit through an upper position 26*a* of the closed retaining Gate 5, additionally, a mid-position 26*b* and a lower position 26*c* are optional exit points as illustrated.

The closed retaining gate 5 comprises moveable cross members 5*a*, FIG. 8 for adjustable placement of the flexible inlet vent pipe 26, so as to provide precise alignments of the flexible inlet vent pipe 26 to a clothes dryer "D" port (not shown).

The retaining gate 5 in the closed position allows positioning of the inlet vent pipe 26 in multiple positions, such as an upper position 26*a*, mid position 26*b*, or lower position 26*c* to allow an efficient connection to one or more clothes dryers. The inlet vent pipe 26 receives exhaust airflow 27 from a clothes dryer "D" and conveys the exhaust airflow 27 through the inlet pipe connector 14, FIG. 1 and into the upper compartment 4.

The retaining gate 5 comprises a hinge 7 FIG. 1, for opening and closing and can be secured in a closed position with a gate latch 8, FIG. 1.

Continuing with FIG. 3, the attachment flange if is illustrated. The attachment flange 1*f* is connected to the housing side walls 1*b*, 1*c*, FIG. 1 and upper wall 1*d*, FIG. 1.

Attachment holes 1*g* allows housing 1 installation to the wall studs "S" within a framing cavity.

Additionally, illustrated in FIG. 3 are the side wall knock outs 26*d* and 26*e* to provide optional exit points for the flexible inlet vent pipe 26 and/or the condensate drain pipe 11.

Access openings 31 are located in the upper compartment 4 for interior maintenance and additionally serves as the openings for the removable windows 32.

The removable windows 32 are secured to the access openings 31 with window frames 33. The removable windows 32 allow interior observation during operations without loss of exhaust airflow 27.

Additionally, illustrated is the removable airflow filter 20, the condensate filter 34 and the Additionally, illustrated is the removable airflow filter 20, the condensate filter 34 and the airflow diverter 29 within the upper compartment 4. Illustrated within the lower compartment 3 is the toxic gas trap 10.

FIG. 4, illustrates prospective detail view of the exhaust airflow diverter 29.

A substantially hollow device with multiple ports for conveying exhaust airflow 27 to selected primary outlet port 29*d* or secondary outlet port 29*c* and direct falling condensate "W" through the weep hole 28 to the condensate port 29*b*.

The rectangular unrestrictive diverter airflow channel 29*a* accepts exhaust airflow 27 from the unrestricted airflow channel 15 through the rectangular unrestricted inlet port 29*g* and into the unrestricted exhaust airflow diverter 29.

The exhaust airflow diverter 29 comprises a moveable damper door 29*f*, FIG. 6 which directs the exhaust airflow 27 to a primary rectangular outlet port 29*d* or to a secondary airflow outlet port 29*c* with a substantially airtight fit to each.

The primary rectangular airflow outlet port 29*d* conveys the exhaust airflow 27 to the airflow through an airflow hood 36*b* into the outlet pipe 36, which continues to convey the exhaust airflow 27 to the outside atmosphere. The secondary airflow outlet port 29*c* conveys the exhaust airflow 27 to an alternate location such as an interior space of a house.

The divertwer 29, primary outlet port 29*d*, secondary outlet port 29*c* and inlet port 29*g* are rectangular to allow unrestricted exhaust airflow 27 of at least 100% capacity received from the 4 inch round inlet vent pipe 26.

The damper door 29*f* pivotally mounted on a hinge is rotatable to close off the entrance to the secondary airflow outlet port 29*c* for directing exhaust airflow 27 into the primary airflow outlet port 29*d* or alternatively close off the primary airflow port 29*d* and direct exhaust airflow 27 into the secondary airflow outlet port 29*c*.

The hinged damper door 29*f* comprises a handle 29*e* to direct the exhaust airflow 27 to either the primary airflow outlet port 29*d* or direct the exhaust airflow 27 to the secondary airflow outlet port 29*c*.

The exhaust airflow diverter 29 is positioned within the operational zone "Z" FIG. 2 located above the top wall of a typical clothes dryer "D", FIG. 2 and below the bottom wall of a typical wall cabinet "C", FIG. 2 for ease of operation by the clothes dryer "D" attendant.

Condensate water "W" falling downward from the exhaust pipe 36 enters into the airflow hood 36*b* and is forced away from the primary exhaust port 29*d*, secondary port 29*c* and inlet port 29*g* by upward and lateral exhaust airflow 27 current, thus forcing condensate "W" to the weep-hole 28 and away from the primary exhaust port 29*d*, second exhaust port 29*c* and inlet port 29*g*.

The condensate water "W" continues to flow by gravity through the weep hole 28 and continues downward to the eccentric condensate port 29*b*.

The condensate port 29*b* is partitioned away from the airflow channel 15 by a separator wall 29*i* which is held approximately 0.25 inches from the diverter floor 29*j* to allow inadvertent water to flow through a clearance space 29*m* between the floor 29*j* and the separator wall 29*i*.

Continuing with FIG. 4, the eccentric condensate drain 29*b* is positioned to accept falling condensate "W" originating from the airflow outlet pipe 36 comprising an intake opening located on the distant side away from the inlet port 29*g*, within the exhaust airflow diverter 29. The eccentric condensate drain 29*b* comprising a slanted configuration angled downward to repel exhaust airflow 27 entry into the eccentric condensate drain 29*b*

The upward flowing current of the exhaust airflow 27 derived from the inlet port 29*g* is directed by a second airflow directional guide 37*a* into the airflow diverter 29, producing airflow pressure against the downward falling condensate "W". forcing the falling condensate "W" toward the distant side wall of the diverter 29, away from the source of exhaust airflow 27 and toward the weep hole 28 and then into the eccentric condensate drain 29*b*.

Additionally, the separator wall 29*i* restricts exhaust airflow 27 from entering the eccentric condensate drain 29*b*. The downward angle of the eccentric condensate drain 29*b* provides additional entry resistance of the exhaust airflow 27.

The pressure of the exhaust airflow 27 entering the exhaust airflow diverter 29 combined with the second airflow directional guide 37*a* produces an angled force of the exhaust airflow 27 against the falling condensate "W" thus preventing the falling condensate "W" from entering the rectangular airflow channel 29*a* while forcing the falling condensate "W" away from the diverter airflow channel 29*a* and towards the eccentric condensate drain 29*b* located at the far side of the diverter 29, away from the upward path of the exhaust airflow 27.

The upward flowing exhaust airflow 27 is able to flow past the falling condensate water "W" and continue through the airflow hood 36*b* into the exhaust pipe 36 or optionally, flow through the secondary airflow outlet port 29*c*.

The falling condensate "W" is forced away from the inlet port 29*g* to the far side of the airflow diverter 29 by the forceful current of the exhaust airflow 27, thus preventing falling condensate "W" from entering inlet vent pipe 26 and continuing into the clothes dryer "D" FIG. 1.

The exhaust airflow 27 is directed away from the eccentric condensate drain 29*b* by the airflow guide 37*a* and separator wall 29*i*.

Additionally, the eccentric condensate drain 29*b* is substantially reduced in diameter and obliquely configured downward and inward to be slanted against the exhaust airflow 27 current, so as to repel exhaust airflow 27 entry.

Additionally, FIG. 4 illustrates the exhaust airflow diverter 29 comprising a damper door 29*f* with a handle 29*e* with means for directing exhaust airflow to the primary rectangular port 29*d* or alternately to the secondary rectangular airflow outlet port 29*c* by blocking the deselected outlet port.

Falling condensate "W" which forms in the airflow pipe 36 is forced against the further side wall of the diverter 29 by the upward and lateral pressure from the exhaust airflow 27 entering the diverter 29 combined with the placement of the drip edge 29*l* within the hood 36*b*.

The falling condensate "W" continues downward through the weep hole 28 into the condensate port 29*b*.

The rectangular configuration of the inlet port 29*g*, primary outlet port 29*d* and secondary outlet port 29*c* sized to 3.5 inch by 4 inch or larger provides over 100% capacity of the exhaust airflow 27 volume received from the 4 inch round inlet vent pipe 26.

The 3.5 inch by 4 inch (14 sq. inch) or larger exhaust airflow 27 passageway through the airflow channel 15 and all other components of the housing 1 exceeds the volume of the 4 inch round (12.56 sq. inch) inlet vent pipe 26.

Thus, the housing 1 provides a non-restricting exhaust airflow 27 passageway design for an unrestricted exhaust airflow 27 passage.

FIG. 5, illustrates a bottom view of the exhaust airflow diverter 29.

The eccentric condensate drain 29*b* is reduced in diameter and slanted downward to repel entry of exhaust airflow 27 through the eccentric condensate drain 29*b*.

Additionally, exhaust airflow 27 is directed away from entering the eccentric condensate drain 29*b* by the second airflow guide 37*a* and the separator wall 29*i*.

Illustrated is the diverter floor 29*j* and the floor valleys 29*k* slanted toward the eccentric condensate drain "29*b*" to carry spill-over condensate water "W" to the eccentric condensate drain 29*b*

FIG. 6 illustrates a detailed view of the airflow diverter 29 connected to the airflow hood 36*b* which is connected to the exhaust pipe 36. In this illustration the damper door 29*f* has been positioned to close off the secondary outlet port 29*c* forcing the exhaust airflow 27 to flow through the primary outlet port 29*d*, and continuing upward through the airflow hood 36*b*, and continuing through the airflow outlet pipe 36 to the outside atmosphere.

Falling condensate water "W" which forms in the airflow pipe 36 is blocked from draining back through the inlet port 29*g* by upward and lateral airflow pressure derived from the inlet port 29*g*, within the airflow diverter 29.

In this illustration, the upward airflow pressure forces the falling condensate water "W" to the far-right side of the airflow diverter 29 for a direct flow path through the weep-hole 28 located on the far-right side wall into the eccentric condensate drain 29*b*, which is also located on the far-right side of the airflow diverter 29.

Additionally, a drip edge 29*l* prevents the falling condensate water "W" from continuing to flow down the left side inside wall of the airflow hood 36*b*, keeping the falling condensate water "W" flowing away from the inlet port 29*g* and toward the weep-hole 28.

Additionally, the separator wall 29*i* blocks exhaust airflow 27 from entering the weep-hole 28 and the eccentric condensate port 29*b*, thus forcing the exhaust airflow 27 upward into the airflow hood 36*b*. The separator wall 29*i* does not reach the diverter floor 29*j*, leaving a clearance gap 29*m* (approximately 0.25 inch) to allow a passageway under the separator wall 29*i* for spill-over condensate water "W" to flow towards the eccentric condensate port 29*b*.

Additionally, the sloped shelf 29*h* directs falling condensate water "W" towards and into the weep-hole 28.

Additionally, the diverter floor 29*j* is sloped towards the eccentric condensate port 29*b* to direct any condensate water "W" that may inadvertently overflow the sloped shelf 29*h*. The features listed above combine to prevent falling condensate water "W" from entering and blocking the clothes dryer vent 26.

FIG. 7, illustrates a detailed view of the airflow diverter 29 connected to the airflow hood 36*b* connected to the exhaust pipe 36. In this illustration the damper door 29*f* has been positioned to close off the primary outlet port 29*d* forcing the exhaust airflow 27 to be directed through the secondary outlet port 29*c* to an interior space such as an interior room.

In this illustration the falling condensate water "W", which forms in the airflow outlet pipe 36 is blocked from flowing into and through the diverter inlet port 29*g* by the damper door 29*f* positioned to seal the primary outlet port 29*d*.

Additionally, the upper surface of the damper door 29*f* is sloped towards the sloped shelf 29*h* to drain falling condensate water "W" towards and into the weep-hole 28.

Additionally, the drip-edge 29*l*, located on the interior wall of the airflow hood 36*b*, uses water adhesion and water cohesion to intercept and collect condensate water "W", which originates from the airflow outlet pipe 36, the condensate water "W" intercepted and collected by the drip-edge 29*l*, succumbs to gravity and falls onto the sloped shelf 29*h* and into the weep-hole 28.

Additionally, one or more drip edges 29*l*, installed within the airflow hood 36*b* to intercept and guide condensate water "W" away from the inlet port 29*g*.

Additionally, the separator wall 29*i* blocks exhaust airflow 27 from entering the weep-hole 28 and the eccentric condensate port 29*b*, thus forcing the exhaust airflow 27 outward through the secondary exhaust port 29*c* into an optional space such as an interior room.

Additionally, the separator wall 29*i* does not reach to or connect with the diverter floor 29*j*, so as to provide a clearance gap 29*m* at the bottom, to allow inadvertent overflow condensate water "W" to flow unencumbered to the eccentric condensate port 29*b*.

Additionally, the diverter floor 29*j* is sloped towards the eccentric condensate port 29*b* to direct any condensate water "W" that inadvertently overflows the sloped shelf 29*h*. The clearance gap 29*m* between the separator wall 29 and the diverter floor 29*j* allows unencumbered passageway for the overflow condensate water "W".

Additionally, the floor flow valleys 29*k* of the diverter floor 29*j* adds additional downward slope through the clearance gap 29*m* towards the eccentric condensate port 29*b* for a more efficient flow.

FIG. 8, illustrates the lower compartment 3 of the housing 1 with the retaining gate 5 in the closed position for containing and organizing the flexible inlet vent pipe 26.

Additionally, the side wall knockouts 26*d* and 26*e* may be optionally utilized to deploy the flexible inlet vent pipe 26 through a side wall of the housing 1 within the lower compartment 3. The retaining gate 5 is supported by hinges 7 and secured by a latch 8 to contain the flexible inlet vent pipe 26.

Additionally, the rear wall 1*e* is shown to better illustrate the housing 1.

FIG. 9 illustrates the double airflow filter unit 20, removed from the airflow filter pocket 19, FIG. 2 of the housing 1, FIG. 2.

The illustration comprising the airflow double filter unit 20 separated from the housing 1 in the open position for cleaning. The preferred arrangement comprises the hollow airflow filter frame 21 securing the two screen holders 24, which are shown in the open position for cleaning.

The screen holders 24, which serves as a holding frame for the screens 25. The screens 25 allow exhaust airflow 27 to pass through while removing lint particulate during cloth dryer "D" operations.

The illustrated open position is for lint removal and inspections.

The screen holders 24 are attached to the filter frame 21 by the frame hinges 22 to allow inwardly folding to a closed position into the filter frame 21. The folded filter unit 20 is inserted into the filter pocket 19, FIG. 2.

The airflow double filter unit 20 is inserted into and removed from the airflow filter pocket 19 with the airflow filter frame handle 23.

Illustrated is the pathway of the exhaust airflow 27 through the double filter unit 20 when in the closed configuration and inserted into the airflow filter pocket 19, FIG. 2.

FIG. 10, illustrates the double airflow filter unit 20 in the closed operational position removed from the airflow filter pocket 19, FIG. 2 of the housing 1, FIG. 2.

Illustrated is the airflow double filter 20 removed from the filter pocket in the operational configuration.

The illustration comprising the hollow airflow filter frame 21 securing the two screen holders 24, which are shown in the closed operational position for inserting into the filter pocket 19, FIG. 2. The screen holders 24 serves as holding frames for the screens 25.

The screens 25 allow exhaust airflow 27 to pass through while removing lint particulate during clothes dryer operations.

The illustrated operational position fits firmly into the filter pocket 19, FIG. 2. The screen holders 24 are attached to the filter frame 21 by the frame hinges 22 to allow unfolding from this operational position to an open position, as in FIG. 9.

The airflow double filter unit 20 is inserted into and removed from the airflow filter pocket 19 with the airflow filter frame handle 23.

Illustrated is the pathway of the exhaust airflow 27 through the double filter unit 20 when inserted into the filter pocket 19 of the housing 1, resulting in the operational configuration.

FIG. 11, illustrates the gaseous fluid exhaust system with a typical washer and dryer arrangement with the housing 1 located behind the dryer. This illustration particularly shows the condensate drain pipe 11 communicating with a typical washer drain. The toxic gas trap 10 serves to prevent entry into the housing 1, of sewer gasses that may escape the washer drain. Additionally, the operational zone "Z" is illustrated to show accessibility by an operator above the clothes dryer top wall.

Additionally, illustrated is the downward sloping rectangular airflow outlet pipe 36, positioned to prevent a water trap which could block airflow.

The front wall, upper compartment 2 and the airflow filter pocket 19 are illustrated above the clothes dryer "D" top wall in the operational zone "Z" for accessibility by a clothes dryer operator.

FIG. 12, illustrates the gaseous fluid exhaust system with a typical washer and dryer arrangement with the housing 1, located behind the clothes dryer "D". This illustration particularly shows the condensate drain pipe 11, communicating with a typical main sewer line. The toxic gas trap 10 serves to prevent entry into the housing 1, of sewer gasses that may escape the sewer line.

The upper compartment 2, and filter pocket are illustrated above the clothes dryer "D" for convenient accessibility by the operator.

FIG. 13, is an additional embodiment illustrating the alternate unrestricting airflow filter **20*a* in a vertical configuration and the alternate airflow diverter 35, located outside the housing 1, and communicating with the airflow outlet pipe 36, additionally, the alternate monitor/alarm 30*a* is attached to the airflow outlet pipe 36**.

The present invention can be constructed from a variety of materials, and for safety considerations is preferable constructed of materials which are substantially fire resistant and have non-flammable and non-melting properties. Suitable materials include metal, ceramic and plastics having the appropriate properties, although other materials are also acceptable.

The present invention can be formed as an integral piece using conventional injection molding techniques know in the art, although the invention is not limited in that regard. For example, the present invention can also be constructed from flat stock metal using sheet metal tools. The invention is capable of taking a number of specific forms without departing from the spirit or essential attributes thereof. Accordingly, the following claims should be referenced to determine the scope of the invention, rather than the foregoing specification.

I claim:

1. A clothes dryer exhaust system comprising:

a housing;

a flexible inlet pipe constructed for receiving lint particulate laden and moist exhaust airflow from a clothes dryer, said flexible inlet pipe having a first open end connected to an exit port of said clothes dryer and a second open end connected to an inlet pipe adapter within said housing;

an unrestricting airflow channel constructed for:

conveying said lint particulate laden and moist exhaust airflow through said housing; and for providing an uninterrupted, unrestricted volume of said lint particulate laden and moist exhaust airflow derived from said clothes dryer;

said lint particulate laden and moist exhaust airflow communicating with a removable exhaust airflow filter, said removable exhaust airflow filter positioned for filtering and removing lint particulate from said lint particulate laden and moist exhaust airflow prior to said lint particulate being exposed to falling condensate, and said unrestricted airflow channel communicating with said removable exhaust airflow filter, to remove said lint particulate from said lint particulate laden and moist exhaust airflow, to produce a lint free moist exhaust airflow;

an exhaust airflow diverter and condensate separator constructed to direct said lint free moist exhaust airflow through one or another designated exhaust airflow outlet ports, said exhaust airflow diverter and condensate separator constructed to:

intercept and separate falling condensate from said lint free moist exhaust airflow, to redirect falling condensate to a separate dedicated condensate outlet port to dispose falling condensate to an external destination; and communicate with one or another designated exhaust airflow outlet ports.

2. The clothes dryer exhaust system of claim 1 further comprising:

multiple compartments comprising:

a substantially open lower compartment, said open lower compartment comprising a hinged barrier constructed for securing and positioning said flexible inlet pipe within said open lower compartment for connections of said flexible inlet pipe to said clothes dryer and said housing; and a substantially closed upper compartment said substantially closed upper compartment comprising a substantially enclosed operational zone constructed to position operational components for efficient accessibility, said operational components comprising:

said removable exhaust airflow filter;

said exhaust airflow diverter and condensate separator;

a condensate filter;

a condensate drain; and an airflow monitor and alarm;

an exhaust airflow outlet pipe substantially rectangular dimensioned to be received within a conventional two-by-four studded wall, and said housing, said exhaust airflow outlet pipe sized to accommodate airflow volume produced by said clothes dryer, and multiple access openings;

multiple viewing windows, wherein said condensate drain comprises a condensate weep hole, a condensate eccentric drain, said condensate filter, a condensate conical pan, a condensate drain trap, a condensate toxic gas trap, said condensate drain constructed for removing falling condensate from said housing and for blocking entry of said lint free moist exhaust airflow into said condensate drain and for blocking entry of sewer gases into said housing wherein, said housing comprises said exhaust airflow outlet pipe, said exhaust airflow outlet pipe having a first open end connected to said exhaust airflow diverter and condensate separator and a second open end terminating outside of said housing;

wherein said airflow monitor and alarm, said condensate filter, and said condensate eccentric drain trap are constructed to prevent entry of incoming sewer gasses, and said substantially enclosed operational zone is positioned to be located above a top surface of said clothes dryer and below a bottom surface of a wall cabinet for accessibility to said substantially enclosed operational zone within said housing, and wherein airflow pressure blocks falling condensate from entering said flexible inlet pipe and said clothes dryer and prevents said lint particulate from blending with falling condensate;

wherein said removable exhaust airflow filter is constructed for removing said lint particulate prior to entering said exhaust airflow outlet pipe.

3. The clothes dryer exhaust system of claim 2 wherein:

said exhaust airflow outlet pipe comprises a substantially constant upward slope or a constant downward slope from said housing and terminating outside of said clothes dryer, said exhaust airflow outlet pipe configured to be of rectangular shape and sized to install within a wall cavity and accommodate total airflow capacity delivered from said clothes dryer;

said airflow monitor and alarm is constructed for indicating volume and velocity, said airflow monitor and alarm comprising a display and probe constructed for indicating system conditions and providing notification of conditions, and said condensate filter constructed for removing and disposing of contaminants from within falling condensate prior to falling condensate flowing through said condensate drain, said condensate filter insertable and removable, said condensate filter placed in said operational zone of said housing for efficient cleaning and maintenance during nonoperational periods of said clothes dryer, said condensate drain constructed for conveying falling condensate from said housing and preventing entry of said lint free moist exhaust airflow;

said condensate drain trap constructed for blocking entry of said lint free moist exhaust airflow, said condensate eccentric drain trap comprising:

an upper receiving end flush with a floor and angled downward for discharging falling condensate water below said floor, an airflow restricting condensate tube being angled and dimensioned to resist entry of said lint free moist exhaust airflow, said airflow restricting condensate tube constructed for disposing of falling condensate water a selected disposal system; and said condensate toxic gas trap is constructed for allowing falling condensate drainage and blocking entry of sewer gasses originating from a sewer system.

4. The clothes dryer exhaust system of claim 2 wherein:

said housing comprises said operational zone, said operational zone comprising an area above said clothes dryer top and within said upper compartment for placement of said operational components within said housing for accessibility by an operator of said clothes dryer, said operational components; reachable within said operational zone comprising said removable airflow filter, said condensate filter, said monitor and alarm, said exhaust airflow diverter and condensate separator, a damper door, said multiple access openings, and said multiple viewing windows.

5. The clothes dryer exhaust system of claim 2, wherein:

said operational components allow nonrestrictive airflow passage;

said operational components comprise said flexible inlet pipe, said inlet pipe adapter, said unrestricting airflow channel, said removable exhaust airflow filter, said exhaust airflow diverter and condensate separator, and said exhaust airflow outlet pipe.

6. The clothes dryer exhaust system of claim 1, wherein:

said housing comprises:

an open lower compartment, said open lower compartment comprising a port to couple said flexible inlet pipe in an undistorted configuration, and a closed upper compartment, and said substantially closed upper compartment comprising said removable exhaust airflow filter, said exhaust airflow diverter and condensate separator, and a condensate drain;

multiple access openings;

multiple viewing windows;

an airflow monitor and alarm, wherein said housing is substantially fire resistant; and wherein an exhaust airflow outlet pipe is communicatively connected with a designated exhaust airflow outlet port.

7. The clothes dryer exhaust system of claim 1, wherein:

said clothes dryer conveys said lint particulate laden and moist exhaust airflow from said clothes dryer exit port through said flexible inlet pipe to within said housing, said lint particulate laden and moist exhaust airflow passes through said unrestricted airflow channel into and through said removable exhaust airflow filter for removing excess lint particulate, rendering said lint particulate laden and moist exhaust airflow substantially lint free moist exhaust airflow, said lint free moist exhaust airflow conveys from said removable exhaust airflow filter into said exhaust airflow diverter and condensate separator to be dispersed into one or another designated exhaust airflow outlet ports, said exhaust airflow diverter and condensate separator constructed for separating said lint free moist exhaust airflow from falling condensate for separate disposal.

8. The clothes dryer exhaust system of claim 1, wherein:

said housing comprises said flexible inlet pipe with said first open end connected to said clothes dryer exit port and said second open end connected to a cylindrical end of said inlet pipe adapter within said housing;

said inlet pipe adapter comprises a hollow interior, a cylindrical inlet port and a rectangular outlet port, said housing comprises two side walls, a rear wall, a bottom wall, top wall, and a closed upper compartment front wall;

an open lower compartment has a substantially open configuration;

said housing has a width of less than sixteen inches and a depth of less than three and one-half inches;

said housing dimensioned and configured for being placed between two-by-four studs spaced sixteen inches on center, mounting flanges extending from said housing side walls, top wall and bottom wall; and components of said housing are manufactured of substantially fire resistant materials.

9. The clothes dryer exhaust system of claim 1 wherein:

said housing comprises said flexible inlet pipe, said flexible inlet pipe substantially hollow, circular, and airtight, said flexible inlet pipe comprising said first open end connected to said clothes dryer exit port and said second open end connected to said inlet pipe adapter within said housing and constructed for conveying exhaust airflow from said clothes dryer into said inlet pipe adapter, said inlet pipe adapter comprising a substantially hollow interior with a cylindrical said first open end and a rectangular said second open end sized to accommodate total exhaust airflow produced by said clothes dryer, and said unrestricting airflow channel within and through said housing sized to accommodate said lint particulate laden and moist exhaust airflow volume produced by said clothes dryer and constructed for conveying said lint particulate laden and moist exhaust airflow through said removable exhaust airflow filter located within said unrestricting airflow channel resulting in said lint free moist exhaust airflow to continue into said exhaust airflow diverter and condensate separator, and said exhaust airflow diverter and condensate separator constructed for, separating falling condensate, and directing said lint free moist exhaust airflow to a selected exhaust airflow outlet, and directing falling condensate to a condensate drain;

said condensate drain comprising means for blocking lint free moist exhaust airflow and further comprising:

wherein said exhaust system is constructed for:

blocking entry of sewer gas into said housing;

directing the outward flowing said lint free moist exhaust airflow to a separate dedicated outlet;

directing falling condensate to a separate dedicated said condensate drain; and preventing falling condensate from entering said clothes dryer.

10. The clothes dryer exhaust system of claim 1 wherein:

said removable airflow filter within said unrestricting airflow channel comprises:

a first airflow screen secured to a first screen frame;

a second airflow screen secured to a second screen frame, said first screen frame and said second screen frame connected by hinges attached to an edge of said first screen frame and to an edge of said second screen frame creating a vertex where said edges meet, such that in a closed configuration said first screen frames and said second screen frame are face to face with spacing between screens, in an open configuration said first screen frames and said second screen frame remain attached creating said vertex with an open angle of up to 180 degrees of each other, wherein:

said closed configuration allows inserting said removable exhaust airflow filter into a receiving pocket within said housing; and said open configuration allows maintenance and lint removal outside said receiving pocket, said removable exhaust airflow filter, in a closed position is configured to fit tightly into said receiving pocket and configured to intercept lint particulate from said lint particulate laden and moist exhaust airflow as it passes through said removable exhaust airflow filter, and said exhaust airflow diverter and condensate separator comprises one or another designated exhaust airflow outlet ports, said exhaust airflow diverter and condensate separator comprising:

a primary outlet port and comprising a secondary outlet port;

a damper door rotatable to a downward position to close off said secondary outlet port or rotatable to an upward position to close off said primary outlet port, wherein when closed off said secondary outlet port allows said lint free moist exhaust airflow to pass through said primary outlet port and, when closed off said primary outlet port allows said lint free moist exhaust airflow passage through said secondary outlet port, when said damper door in said upward position closes said primary outlet port, wherein said primary outlet port comprises a sloped top surface sloped to a weep-hole and a bottom surface of said damper door in said upward position being substantially flat;

wherein when said damper door is in said downward position for closing said secondary outlet port, said top surface becomes an inside surface and said bottom surface becomes an outside surface;

wherein when said damper door is in said upward position, said sloped top surface of said damper door is in alignment with said sloped top surface of a sloped shelf resulting in a continuous sloping grade to said weep-hole for falling condensate water drainage;

wherein when said damper door is in said upward position, which closes said primary outlet port, said top surface of said damper door is coplanar to the sloped top surface of said sloped shelf, resulting in a continuous downward drainage of falling condensate to said weep-hole;

wherein said exhaust airflow diverter and condensate separator is constructed for separating falling condensate, which forms inside an exhaust airflow outlet pipe from said lint particulate laden and moist exhaust airflow;

wherein said clothes dryer exhaust system further comprises condensate drip-edges, attached to an interior wall of said exhaust airflow outlet pipe constructed for intercepting and redirecting falling condensate toward said weep-hole to drain falling condensate into said condensate eccentric drain trap, which additionally blocks entry of said lint free moist exhaust airflow while accepting entry of falling condensate; and wherein a condensate filter is constructed for:

removing contaminates from falling condensate and for restricting entry of said lint free moist exhaust airflow through said eccentric condensate filter; and draining falling condensate into a conical pan and sending falling condensate through said condensate eccentric drain trap and through a condensate toxic gas trap, into a condensate drain pipe for disposal.

* * * * *